US007108580B2

(12) United States Patent
Ushio et al.

(10) Patent No.: US 7,108,580 B2
(45) Date of Patent: Sep. 19, 2006

(54) METHOD AND DEVICE FOR SIMULATION, METHOD AND DEVICE FOR POLISHING, METHOD AND DEVICE FOR PREPARING CONTROL PARAMETERS OR CONTROL PROGRAM, POLISHING SYSTEM, RECORDING MEDIUM, AND METHOD OF MANUFACTURING SEMICONDUCTOR DEVICE

(75) Inventors: Yoshijiro Ushio, Yokohama (JP); Kiyoshi Iizuka, Tokyo (JP)

(73) Assignee: Nikon Corporation, Tokyo (JP)

( * ) Notice: Subject to any disclaimer, the term of this patent is extended or adjusted under 35 U.S.C. 154(b) by 99 days.

(21) Appl. No.: 10/774,623

(22) Filed: Feb. 10, 2004

(65) Prior Publication Data

US 2004/0248411 A1 Dec. 9, 2004

Related U.S. Application Data

(63) Continuation of application No. PCT/JP02/08349, filed on Aug. 19, 2002.

(30) Foreign Application Priority Data

Aug. 22, 2001 (JP) ..... 2001-251421

(51) Int. Cl.
*B24B 51/00* (2006.01)

(52) U.S. Cl. ..... 451/8

(58) Field of Classification Search ..... 451/5, 451/8, 10, 28, 36; 716/5, 19; 438/689
See application file for complete search history.

(56) References Cited

U.S. PATENT DOCUMENTS 5,599,423 A 2/1997 Parker et al.
2001/0039462 A1* 11/2001 Mendez et al. ..... 700/45
2001/0044257 A1* 11/2001 Southwick ..... 451/21
2002/0076933 A1* 6/2002 Kawamura et al. ..... 438/691
2003/0022596 A1* 1/2003 Meyer ..... 451/5
2003/0139122 A1* 7/2003 Lawing ..... 451/288

FOREIGN PATENT DOCUMENTS

| | | |
|---|---|---|
| JP | 6-315849 | 11/1994 |
| JP | 10-296628 | 11/1998 |
| JP | 11-126765 | 5/1999 |
| JP | 11-186205 | 7/1999 |
| JP | 2001-219366 | 8/2001 |
| JP | 2002-140655 | 5/2002 |

* cited by examiner

*Primary Examiner*—Jacob K. Ackun, Jr.
(74) *Attorney, Agent, or Firm*—Morgan, Lewis & Bockius, LLP

(57) ABSTRACT

The preparation apparatus 4 determines the target distribution of the amount of polishing on the basis of the film thickness of the wafer 2 measured by the measuring apparatus 3. The preparation apparatus 4 assumes a control program for the purpose of controlling the polishing apparatus 1, and predicts the distribution of the amount of polishing that is obtained after the wafer 2 is polished by the polishing apparatus 1 in accordance with the assumed control program. In this case, the amount of polishing in individual partial regions of the polished surface of the wafer 2 is predicted using an indicator that indicates the height distribution of the polishing surface of the polishing pad 14 (when no pressure is applied to this polishing pad) as one parameter. The preparation apparatus 4 judges the acceptability of the assumed control program by comparing the predicted distribution of the amount of polishing and the target distribution of the amount of polishing. The polishing apparatus 1 polishes the wafer 2 in accordance with a control program that has been judged to be acceptable. As a result, the desired film thickness distribution on the side of the polished surface of the object of polishing can be simulated with good precision.

7 Claims, 14 Drawing Sheets

METHOD AND DEVICE FOR SIMULATION, METHOD AND DEVICE FOR POLISHING, METHOD AND DEVICE FOR PREPARING CONTROL PARAMETERS OR CONTROL PROGRAM, POLISHING SYSTEM, RECORDING MEDIUM, AND METHOD OF MANUFACTURING SEMICONDUCTOR DEVICE

The present application is a continuation of PCT International Application No. PCT/JP02/08349 filed Aug. 19, 2002, which is hereby incorporated by reference.

TECHNICAL FIELD

The present invention relates to a simulation method and apparatus relating to polishing, a polishing method and apparatus, a method and apparatus for preparing control programs or the like used to control the polishing apparatus, a simulation program recording medium relating to polishing, a program recording medium for the preparation of control programs or the like, a polishing system, and a semiconductor device manufacturing method.

For example, the present invention is suitable for use in connection with the flattening polishing of semiconductor devices (e.g., the removal process of semiconductor wafers or dielectric layers or metal layers formed on such semiconductor wafers in semiconductor element formation) or the like in methods used to manufacture semiconductor devices such as ULSI.

BACKGROUND ART

The increase in the density of semiconductor devices has continued to expand without showing any limits, and the development of various techniques and methods has been pursued in order to realize such a high density. One of these techniques is multi-layer wiring; technical problems that accompany this technique include global flattening of the device surface (i.e., flattening over a relatively large area) and wiring between upper and lower layers.

Considering the shortening of the focal depth during exposure that has accompanied the shortening of the wavelengths used in lithography, there is a great requirement for precision in the flattening of inter-layer layers at least in the range of the exposed area. Furthermore, the requirement for so-called inlay (plug, damascene) which is the embedding of metal electrode layers has also increased for the realization of multi-layer wiring; in this case, the removal of excess metal layers and flattening following lamination must be performed. Chemical mechanical polishing has attracted attention as an efficient flattening technique for such large (die size level) areas. This is a polishing process called CMP (chemical mechanical polishing or planarization). CMP is a process which removes the surface layers of wafers by using a chemical action in combination with physical polishing, and is the strongest candidate for global flattening and electrode formation techniques.

In concrete terms, a polishing agent called a slurry is used in which abrasive grains (generally silica, alumina, cerium oxide or the like) are dispersed in a solvent such as an acid, alkali or oxidizing agent, etc., that can dissolve the object of polishing; furthermore, a polishing tool is used which has an appropriate polishing body (polishing body such as a polishing pad) and a substrate such as a polishing platen that supports the surface of this polishing body on the side opposite the polishing surface so that the wafer surface is pressed by the above-mentioned polishing body, and polishing is caused to proceed by rubbing through a relative motion.

As the use of the above-mentioned polishing body progresses, the polishing capacity drops as a result of clogging of the polishing surface of the polishing body, etc. Conventionally, therefore, dressing of the polishing body has been performed either simultaneously with the polishing process or separately from the polishing process, so that the polishing surface of the polishing body is planed away.

In order to improve the process efficiency of such a CMP polishing process, and in order to improve the precision of the flatness, it is extremely important to predict the amount of polishing with good precision, and to achieve efficient optimization of the polishing conditions (control parameters of the polishing apparatus, etc.) on the basis of the results of this prediction. Accordingly, a simulation relating to CMP has been proposed, for example, in U.S. Pat. No. 5,599,423.

Furthermore, in polishing other than CMP as well, e.g., in general polishing such as the polishing of optical members (lenses, etc.) and the grinding of wafers, the importance of simulations relating to polishing has been recognized, and various simulation methods have been proposed.

In simulations relating to polishing, the prediction of the amount of polishing is fundamental. Furthermore, in the case of various simulations relating to polishing that have been proposed in the past, the prediction of the amount of polishing has been accomplished according to the equation of Preston expressed by equation (1) shown below. In equation (1), h is the amount by which the object of polishing (polished object) is polished (i.e., the amount of polishing), $\eta$ is the Preston constant, P is the load (pressure applied to the object of polishing), V is the contact relative velocity between the polishing body and the object of polishing (i.e., the contact relative velocity in the partial region where the amount of polishing is to be determined), and t is the polishing time.

$$h=\eta PVt \tag{1}$$

This equation of Preston is an empirical rule; however, it is considered that this equation allows the determination of the amount of polishing with extremely good precision, and this equation is treated as a fundamental principle, forming the foundation of all simulations relating to polishing.

When the equation of Preston is applied in conventional simulations relating to polishing, the load P is given with the assumption being made that the polishing surface of the polishing body of the polishing tool is always maintained in a flat state with a high degree of precision.

However, as polishing progresses, the polishing body of the polishing tool is very gradually worn away. In addition, as the dressing process progresses, the polishing body of the polishing tool is worn away by a relatively large amount. Furthermore, such wearing processes of the polishing body are not always uniform in all parts of the polishing surface; there is some variation between respective parts of the polishing body. Accordingly, as the use of the polishing body progresses, the thickness of various parts of the polishing body gradually decreases; moreover, indentations and protrusions are generated in the polishing surface of the polishing body. As a result, because of such variations in thickness and generation of indentations and protrusions, the load that is actually applied between individual partial regions of the polished surface of the object of polishing and the polishing surface of the polishing body differs from the load that is applied in a case where the polishing surface of the polishing body is maintained in a flat state with a high degree of precision.

Accordingly, in the case of the above-mentioned conventional simulations relating to polishing, since the load P is given with the assumption being made that the polishing surface of the polishing body of the polishing tool is always maintained in a flat state with a high degree of precision when the equation of Preston is applied, the precision of the simulation of the amount of polishing drops as a result of being affected by the generation of indentations and protrusions in the polishing surface of the polishing body and the like. Specifically, since the effects of the generation of indentations and protrusions in the polishing surface of the polishing body and the like are not taken into account in the above-mentioned conventional simulations relating to polishing, the precision of the simulation of the amount of polishing drops. When the precision of the simulation of the amount of polishing thus drops, it becomes difficult to optimize the polishing conditions (control parameters of the polishing apparatus, etc.) with good efficiency; as a result, it becomes impossible to increase the process efficiency of the CMP polishing process, and the precision of the flatness drops.

The situations described above apply not only to CMP, but also to other types of polishing, e.g., the polishing of optical members such as lenses.

DISCLOSURE OF THE INVENTION

The present invention was devised in light of the above facts. It is a first object of the present invention to provide a simulation method and apparatus which make it possible to predict with good precision the distribution of the amount of polishing of the polished surface of an object of polishing following polishing, and a recording medium on which a program for this purpose is recorded.

Furthermore, it is a second object of the present invention to provide a simulation method and apparatus which make it possible to predict with good precision the surface shape of the polished surface or film thickness distribution of the polished surface of the object of polishing following polishing, and a recording medium on which a program for this purpose is recorded.

Moreover, it is a third object of the present invention to provide a method and apparatus which make it possible to prepare, on the basis of a high-precision prediction of the amount of polishing, polishing apparatus control parameters or control programs that are required in order to obtain the desired shape of the polished surface or desired film thickness distribution of the polished surface of the object of polishing with good precision, and a recording medium on which a program for this purpose is recorded.

In addition, it is a fourth object of the present invention to provide a polishing method and apparatus which make it possible to obtain the desired surface shape of the polished surface of the object of polishing or desired film thickness distribution on the side of this polished surface with good precision.

Likewise, it is a fifth object of the present invention to provide a polishing system which makes it possible to obtain the desired surface shape of the polished surface of the object of polishing or desired film thickness distribution on the side of this polished surface with good precision, and to increase the efficiency of the polishing process.

Furthermore, it is a sixth object of the present invention to provide a semiconductor device manufacturing method which can increase the process efficiency and improve the yield, and which makes it possible to manufacture semiconductor devices at a low cost compared to conventional semiconductor device manufacturing methods.

Inventions that are used in order to achieve the above-mentioned objects will be described below; however, it goes without saying that the individual inventions among these inventions described below are not inventions that achieve all of the six objects described above. Exactly which object is achieved by which invention will be clear from the description of the constructions of the respective inventions and the description of the working configurations and embodiments shown below.

The first invention that is used in order to achieve the above-mentioned objects is a simulation method which predicts the distribution of the amount of polishing of the polished surface of an object of polishing after this object of polishing has been polished by causing relative motion between this object of polishing and a polishing body that is supported by a substrate while applying a load between this object of polishing and the above-mentioned polishing body, this simulation method being characterized by the fact that a step which predicts the amount of polishing in individual partial regions of the polished surface of the above-mentioned object of polishing following the polishing of this object of polishing includes the height distribution, or an indicator which indicates the height distribution, of the polishing surface of the above-mentioned polishing body with reference to the above-mentioned substrate when no pressure is applied to this polishing body, as one of the parameters used in the calculations performed in this step.

The second invention that is used in order to achieve the above-mentioned objects is the above-mentioned first invention, which is characterized by the fact that the above-mentioned indicator is one indicator or a combination of two or more indicators selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The third invention that is used in order to achieve the above-mentioned objects is the above-mentioned first invention, which is characterized by the fact that the above-mentioned height distribution of the above-mentioned polishing body is successively measured or predicted during the time of use of the above-mentioned polishing body, and the amount of polishing in the above-mentioned partial regions is predicted on the basis of the most recently measured or predicted height distribution.

The fourth invention that is used in order to achieve the above-mentioned objects is the above-mentioned third invention, which is characterized by the fact that the measurement or prediction of the above-mentioned height distribution is performed following a dressing process that dresses the above-mentioned polishing body.

The fifth invention that is used in order to achieve the above-mentioned objects is the above-mentioned third invention or fourth invention, which is characterized by the fact that the measurement or prediction of the above-mentioned height distribution is performed following a polishing process performed by the above-mentioned polishing body on an object of polishing that is different from the above-mentioned object of polishing.

The sixth invention that is used in order to achieve the above-mentioned objects is any of the above-mentioned third through sixth inventions, which is characterized by the fact that the prediction of the above-mentioned height distribution is accomplished by referring to a look-up table or equation which shows the relationship between the above-mentioned height distribution and one parameter or a combination of two or more parameters selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The seventh invention that is used in order to achieve the above-mentioned objects is any of the above-mentioned third through sixth inventions, which is characterized by the fact that the prediction of the above-mentioned height distribution is performed according to the equation of Preston.

The eighth invention that is used in order to achieve the above-mentioned objects is any of the above-mentioned first through seventh inventions, which is characterized by the fact that the polishing of the above-mentioned object of polishing is chemical mechanical polishing which is performed with a polishing agent interposed between the above-mentioned polishing body and the above-mentioned object of polishing.

The ninth invention that is used in order to achieve the above-mentioned objects is a simulation method which predicts the shape of the polished surface of an object of polishing or the film thickness distribution on the side of the above-mentioned polished surface after the above-mentioned object of polishing has been polished by causing relative motion between this object of polishing and a polishing body that is supported by a substrate while applying a load between this object of polishing and the above-mentioned polishing body, this simulation method being characterized by the fact that the above-mentioned shape or the above-mentioned film thickness distribution of the above-mentioned object of polishing is predicted using the simulation method of any of the above-mentioned first through eighth inventions.

The tenth invention that is used in order to achieve the above-mentioned objects is a control parameter or control program preparation method which prepares control parameters or a control program used to control a polishing apparatus which polishes an object of polishing by causing relative motion between this object of polishing and a polishing body that is supported by a substrate while applying a load between this object of polishing and the above-mentioned polishing body, this method being characterized by the fact that the method comprises a simulation stage in which the distribution of the amount of polishing of the above-mentioned polished surface (that is obtained after the above-mentioned object of polishing has been polished by the above-mentioned polishing apparatus) is predicted according to assumed or set control parameters or an assumed or set control program using the simulation method according to any of the above-mentioned first through ninth inventions, and a judgement stage in which the acceptability of the above-mentioned assumed or set control parameters or control program is judged by comparing the distribution of the amount of polishing predicted in the above-mentioned simulation stage and a target distribution of the amount of polishing of the polished surface of the above-mentioned object of polishing.

The eleventh invention that is used in order to achieve the above-mentioned objects is the above-mentioned tenth invention, which is characterized by the fact that in cases where a judgement of "unacceptable" is made in the above-mentioned judgement stage, the above-mentioned assumed or set control parameters or control program are changed to control parameters or a control program which are altered at least in part with respect to the control parameters or control program already judged to be "unacceptable" in the above-mentioned judgement stage, and the above-mentioned simulation stage and above-mentioned judgement stage are repeated in that order until the control parameters or control program obtained are judged to be "acceptable."

The twelfth invention that is used in order to achieve the above-mentioned objects is a simulation apparatus which predicts the distribution of the amount of polishing of the polished surface of an object of polishing after this object of polishing has been polished by causing relative motion between this object of polishing and a polishing body that is supported by a substrate while applying a load between this object of polishing and the above-mentioned polishing body, this apparatus being characterized by the fact that the apparatus has prediction means for predicting the amount of polishing in individual partial regions of the polished surface of the above-mentioned object of polishing following the polishing of this object of polishing, and these prediction means use the height distribution, or an indicator which indicates the height distribution, of the polishing surface of the above-mentioned polishing body with reference to the above-mentioned substrate when no pressure is applied to this polishing body, as one of the parameters used in the calculations performed by these prediction means.

The thirteenth invention that is used in order to achieve the above-mentioned objects is the above-mentioned twelfth invention, which is characterized by the fact that the above-mentioned indicator is one indicator or a combination of two or more indicators selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The fourteenth invention that is used in order to achieve the above-mentioned objects is the above-mentioned twelfth invention, which is characterized by the fact that the apparatus further comprises means for successively measuring or predicting the above-mentioned height distribution of the above-mentioned polishing body during the time of use of this polishing body, and the above-mentioned prediction means predict the amount of polishing in the above-mentioned partial regions on the basis of the most recently measured or predicted height distribution.

The fifteenth invention that is used in order to achieve the above-mentioned objects is the above-mentioned fourteenth invention, which is characterized by the fact that the above-mentioned means for measuring or predicting the above-mentioned height distribution perform the measurement or prediction of the above-mentioned height distribution following a dressing process that dresses the above-mentioned polishing body.

The sixteenth invention that is used in order to achieve the above-mentioned objects is the above-mentioned fourteenth invention or fifteenth invention, which is characterized by the fact that the above-mentioned means for measuring or predicting the above-mentioned height distribution perform the measurement or prediction of the above-mentioned height distribution following a polishing process performed by the above-mentioned polishing body on an object of polishing that is different from the above-mentioned object of polishing.

The seventeenth invention that is used in order to achieve the above-mentioned objects is any of the above-mentioned fourteenth through sixteenth inventions, which is characterized by the fact that the above-mentioned means for measuring or predicting the above-mentioned height distribution perform the prediction of the above-mentioned height distribution by referring to a look-up table or equation which shows the relationship between the above-mentioned height distribution and one parameter or a combination of two or more parameters selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The eighteenth invention that is used in order to achieve the above-mentioned objects is any of the above-mentioned fourteenth through seventeenth inventions, which is characterized by the fact that the above-mentioned means for measuring or predicting the above-mentioned height distribution perform the prediction of the above-mentioned height distribution according to the equation of Preston.

The nineteenth invention that is used in order to achieve the above-mentioned objects is any of the above-mentioned twelfth through eighteenth inventions, which is characterized by the fact that the polishing of the above-mentioned object of polishing is chemical mechanical polishing which is performed with a polishing agent interposed between the above-mentioned polishing body and the above-mentioned object of polishing.

The twentieth invention that is used in order to achieve the above-mentioned objects is a simulation apparatus which predicts the shape of the polished surface of an object of polishing or the film thickness distribution on the side of the above-mentioned polished surface after the above-mentioned object of polishing has been polished by causing relative motion between this object of polishing and a polishing body that is supported by a substrate while applying a load between this object of polishing and the above-mentioned polishing body, this simulation apparatus being characterized by the fact that the apparatus comprises prediction means for predicting the above-mentioned shape or the above-mentioned film thickness distribution of the above-mentioned object of polishing using the simulation method according to any of the above-mentioned first through ninth inventions.

The twenty-first invention that is used in order to achieve the above-mentioned objects is a simulation apparatus which predicts the shape of the polished surface of an object of polishing or the film thickness distribution on the side of the above-mentioned polished surface after the above-mentioned object of polishing has been polished by causing relative motion between this object of polishing and a polishing body that is supported by a substrate while applying a load between this object of polishing and the above-mentioned polishing body, this simulation apparatus being characterized by the fact that the apparatus comprises prediction means for predicting the above-mentioned shape or the above-mentioned film thickness distribution of the above-mentioned object of polishing using the simulation apparatus according to any of the above-mentioned twelfth through nineteenth inventions.

The twenty-second invention that is used in order to achieve the above-mentioned objects is a control parameter or control program preparation apparatus which prepares control parameters or a control program used to control a polishing apparatus which polishes an object of polishing by causing relative motion between this object of polishing and a polishing tool which has a polishing body and a substrate that supports the surface of this polishing body on the side opposite the polishing surface while applying a load between the above-mentioned object of polishing and the above-mentioned polishing body of the above-mentioned polishing tool, this apparatus being characterized by the fact that the apparatus comprises simulation means for predicting the distribution of the amount of polishing of the above-mentioned polished surface (that is obtained after the above-mentioned object of polishing has been polished by the above-mentioned polishing apparatus) according to assumed or set control parameters or an assumed or set control program using the simulation method according to any of the above-mentioned first through ninth inventions, and judgement means for judging the acceptability of the above-mentioned assumed or set control parameters or control program by comparing the distribution of the amount of polishing predicted by the above-mentioned simulation means and a target distribution of the amount of polishing of the polished surface of the above-mentioned object of polishing.

The twenty-third invention that is used in order to achieve the above-mentioned objects is the above-mentioned twenty-second invention, which is characterized by the fact that the apparatus comprises means which change the above-mentioned assumed or set control parameters or control program to control parameters or a control program that are altered at least in part with respect to the control parameters or control program already judged to be "unacceptable" by the above-mentioned judgement means in cases where a judgement of "unacceptable" is made in the above-mentioned judgement stage, and which cause the above-mentioned simulation means and the above-mentioned judgement means to repeat their operation in that order until the control parameters or control program obtained are judged to be "acceptable."

The twenty-fourth invention that is used in order to achieve the above-mentioned objects is a method for polishing an object of polishing using a polishing apparatus which polishes this object of polishing by causing relative motion between this object of polishing and a polishing body that is supported by a substrate while applying a load between this object of polishing and the above-mentioned polishing body, this polishing method being characterized by the fact that the above-mentioned object of polishing is polished by operating the above-mentioned polishing apparatus in accordance with control parameters or a control program prepared by the control parameter or control program preparation method according to the above-mentioned tenth invention or eleventh invention.

The twenty-fifth invention that is used in order to achieve the above-mentioned objects is a method for polishing an object of polishing using a polishing apparatus which polishes this object of polishing by causing relative motion between this object of polishing and a polishing body that is supported by a substrate while applying a load between this object of polishing and the above-mentioned polishing body, this polishing method being characterized by the fact that the above-mentioned object of polishing is polished by operating the above-mentioned polishing apparatus in accordance with control parameters or a control program prepared using the simulation method according to any of the above-mentioned first through ninth inventions.

The twenty-sixth invention that is used in order to achieve the above-mentioned objects is a method for polishing an object of polishing using a polishing apparatus which polishes this object of polishing by causing relative motion between this object of polishing and a polishing body that is supported by a substrate while applying a load between this object of polishing and the above-mentioned polishing body, this polishing method being characterized by the fact that the above-mentioned object of polishing is polished by operating the above-mentioned polishing apparatus in accordance with different control parameters or a different control program according to the height distribution, or an indicator which indicates the height distribution, of the polishing surface of the above-mentioned polishing body with reference to the above-mentioned substrate when no pressure is applied to this polishing body.

The twenty-seventh invention that is used in order to achieve the above-mentioned objects is the above-mentioned twenty-sixth invention, which is characterized by the fact that the above-mentioned indicator is one indicator or a combination of two or more indicators selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The twenty-eighth invention that is used in order to achieve the above-mentioned objects is a polishing apparatus which polishes an object of polishing by causing relative motion between this object of polishing and a polishing body that is supported by a substrate while applying a load between this object of polishing and the above-mentioned polishing body, this polishing apparatus being characterized by the fact that the above-mentioned object of polishing is polished in accordance with parameters prepared using control parameters or a control program prepared by the control program preparation method of the above-mentioned tenth invention or eleventh invention.

The twenty-ninth invention that is used in order to achieve the above-mentioned objects is a polishing apparatus which polishes an object of polishing by causing relative motion between this object of polishing and a polishing body that is supported by a substrate while applying a load between this object of polishing and the above-mentioned polishing body, this polishing apparatus being characterized by the fact that the above-mentioned object of polishing is polished in accordance with control parameters or a control program prepared using the simulation method according to any of the above-mentioned first through ninth inventions.

The thirtieth invention that is used in order to achieve the above-mentioned objects is a polishing apparatus which polishes an object of polishing by causing relative motion between this object of polishing and a polishing body that is supported by a substrate while applying a load between this object of polishing and the above-mentioned polishing body, this polishing apparatus being characterized by the fact that the apparatus comprises control means for controlling the operation of the above-mentioned polishing using different control parameters or in accordance with a different control program according to the height distribution, or an indicator which indicates the height distribution, of the polishing surface of the above-mentioned polishing body with reference to the above-mentioned substrate when no pressure is applied to this polishing body.

The thirty-first invention that is used in order to achieve the above-mentioned objects is the above-mentioned thirtieth invention, which is characterized by the fact that the above-mentioned indicator is one indicator or a combination of two or more indicators selected from a set comprising the number of times that a dressing process is performed on the above-mentioned polishing body, the cumulative time of the dressing processes performed on the above-mentioned polishing body, the number of times that polishing is performed on the above-mentioned object of polishing by the above-mentioned polishing body, and the cumulative time of the polishing that is performed on the above-mentioned object of polishing by the above-mentioned polishing body.

The thirty-second invention that is used in order to achieve the above-mentioned objects is any of the above-mentioned twenty-eighth through thirty-first inventions, which is characterized by the fact that the polishing of the above-mentioned object of polishing is chemical mechanical polishing which is performed with a polishing agent interposed between the above-mentioned polishing body and the above-mentioned object of polishing.

The thirty-third invention that is used in order to achieve the above-mentioned objects is a computer-readable recording medium on which a program is recorded that is used to realize in a computer a simulation function that predicts the distribution of the amount of polishing of the polished surface of an object of polishing after this object of polishing has been polished by causing relative motion between this object of polishing and a polishing body that is supported by a substrate while applying a load between this object of polishing and the above-mentioned polishing body, this recording medium being characterized by the fact that the above-mentioned simulation function simulates the amount of polishing in individual partial regions of the polished surface of the above-mentioned object of polishing following the polishing of this object of polishing, and this function includes a function that simulates the amount of polishing using the height distribution, or an indicator which indicates the height distribution, of the polishing surface of the above-mentioned polishing body with reference to the above-mentioned substrate when no pressure is applied to this polishing body, as one of the parameters used in the calculations performed by this function.

The thirty-fourth invention that is used in order to achieve the above-mentioned objects is a computer-readable recording medium on which a program is recorded that is used to realize in a computer a simulation function that predicts the shape of the polished surface of an object of polishing or the film thickness distribution on the side of the above-mentioned polished surface after this object of polishing has been polished by causing relative motion between this object of polishing and a polishing body that is supported by a substrate while applying a load between this object of polishing and the above-mentioned polishing body, this recording medium being characterized by the fact that the above-mentioned simulation function is a function which calculates the amount of polishing in individual partial regions of the polished surface of the above-mentioned object of polishing following the polishing of this object of polishing, and this function includes a function that performs calculations using the height distribution, or an indicator which indicates the height distribution, of the polishing surface of the above-mentioned polishing body with reference to the above-mentioned substrate when no pressure is applied to this polishing body, as one of the parameters used in the calculations performed by this function.

The thirty-fifth invention that is used in order to achieve the above-mentioned objects is a computer-readable recording medium on which a program is recorded that is used to cause a computer to execute preparation processing which prepares control parameters or a control program used to control a polishing apparatus that polishes an object of polishing by causing relative motion between this object of polishing and a polishing body that is supported by a substrate while applying a load between this object of polishing and the above-mentioned polishing body, this recording medium being characterized by the fact that the above-mentioned preparation processing includes (a) a simulation stage in which the distribution of the amount of polishing of the above-mentioned polished surface (that is obtained after the above-mentioned object of polishing has been polished by the above-mentioned polishing apparatus) is predicted in accordance with assumed or set control parameters or an assumed or set control program, and (b) a judgement stage in which the acceptability of the control parameters or control program assumed in the above-mentioned assuming stage is judged by comparing the distribution of the amount of polishing predicted in the above-mentioned simulation stage with a target distribution of the amount of polishing of the polished surface of the above-mentioned object of polishing, and the above-mentioned simulation stage includes a stage in which the amount of polishing in individual partial regions of the polished surface of the above-mentioned object of polishing following the polishing of this object of polishing is predicted using the height distribution, or an indicator which indicates the height distribution, of the polishing surface of the above-mentioned polishing body with reference to the above-mentioned substrate when no pressure is applied to this polishing body, as one of the parameters used in the calculations performed in this stage.

The thirty-sixth invention that is used in order to achieve the above-mentioned objects is the above-mentioned thirty-fifth invention, which is characterized by the fact that in cases where a judgement of "unacceptable" is made in the above-mentioned judgement stage, the above-mentioned control parameter or control program preparation processing changes the above-mentioned assumed or set control parameters or control program to control parameters or a control program which are altered at least in part with respect to the control parameters or control program already judged to be "unacceptable" in the above-mentioned judgement stage, and the above-mentioned simulation stage and above-mentioned judgement stage are repeated in that order until the control parameters or control program obtained are judged to be "acceptable."

The thirty-seventh invention that is used in order to achieve the above-mentioned objects is a polishing system which comprises a polishing apparatus that polishes an object of polishing by causing relative motion between this object of polishing and a polishing body that is supported by a substrate while applying a load between this object of polishing and the above-mentioned polishing body, and a control parameter or control program preparation apparatus which prepares control parameters or a control program used to control the above-mentioned polishing apparatus, this polishing system being characterized by the fact that the above-mentioned control parameter or control program preparation apparatus includes (a) simulation means for predicting the distribution of the amount of polishing of the above-mentioned polished surface (that is obtained after the above-mentioned object of polishing has been polished by the above-mentioned polishing apparatus) according to assumed or set control parameters or an assumed or set control program using the simulation method according to any of the above-mentioned first through ninth inventions, and (b) judgement means for judging the acceptability of the control parameters or control program assumed in the above-mentioned assuming means by comparing the distribution of the amount of polishing predicted by the above-mentioned simulation means and the above-mentioned target distribution of the amount of polishing, and the above-mentioned polishing apparatus polishes the above-mentioned object of polishing in accordance with control parameters or a control program prepared by the above-mentioned control parameter or control program preparation apparatus.

The thirty-eighth invention that is used in order to achieve the above-mentioned objects is a polishing system which comprises a polishing apparatus that polishes an object of polishing by causing relative motion between this object of polishing and a polishing body that is supported by a substrate while applying a load between this object of polishing and the above-mentioned polishing body, and a control parameter or control program preparation apparatus which prepares control parameters or a control program used to control the above-mentioned polishing apparatus, this polishing system being characterized by the fact that the above-mentioned control parameter or control program preparation apparatus includes (a) simulation means for predicting the distribution of the amount of polishing of the above-mentioned polished surface (that is obtained after the above-mentioned object of polishing has been polished by the above-mentioned polishing apparatus) according to assumed or set control parameters or an assumed or set control program using the simulation apparatus according to any of the above-mentioned twelfth through twenty-first inventions, and (b) judgement means for judging the acceptability of the control parameters or control program assumed by the above-mentioned assuming means by comparing the distribution of the amount of polishing predicted by the above-mentioned simulation means and the above-mentioned target distribution of the amount of polishing, and the above-mentioned polishing apparatus polishes the above-mentioned object of polishing in accordance with control parameters or a control program prepared by the above-mentioned control parameter or control program preparation apparatus.

The thirty-ninth invention that is used in order to achieve the above-mentioned objects is the above-mentioned thirty-seventh invention or thirty-eighth invention, which is characterized by the fact that in cases where a judgement of "unacceptable" is made in the above-mentioned judgement stage, the above-mentioned control parameter or control program preparation processing changes the above-mentioned assumed or set control parameters or control program to control parameters or a control program which are altered at least in part with respect to the control parameters or control program already judged to be "unacceptable" in the above-mentioned judgement stage, and the above-mentioned simulation stage and above-mentioned judgement stage are repeated in that order until the control parameters or control program obtained are judged to be "acceptable."

The fortieth invention that is used in order to achieve the above-mentioned objects is any of the above-mentioned thirty-seventh through thirty-ninth inventions, which is characterized by the fact that the input of the control parameters or control program prepared by the above-mentioned control parameter or control program preparation apparatus into the above-mentioned polishing apparatus is performed automatically or in response to commands.

The forty-first invention that is used in order to achieve the above-mentioned objects is any of the above-mentioned thirty-seventh through fortieth inventions, which is characterized by the fact that the polishing of the above-mentioned object of polishing is chemical mechanical polishing which is performed with a polishing agent interposed between the above-mentioned polishing body and the above-mentioned object of polishing.

The forty-second invention that is used in order to achieve the above-mentioned objects is a semiconductor device manufacturing method which is characterized by the fact that this method has a process in which the surface of a semiconductor wafer is flattened using the polishing apparatus of any of the above-mentioned twenty-eighth through thirty-second inventions, or the polishing system of any of the above-mentioned thirty-seventh through forty-first inventions.

BEST MODE FOR CARRYING OUT THE INVENTION

Below, the polishing method and apparatus, simulation method and apparatus relating to polishing, method and apparatus for preparing a control program or the like used to control the polishing apparatus, simulation program recording medium relating to polishing, program recording medium used for the preparation of a control program, etc., polishing system, semiconductor device manufacturing method, and semiconductor device provided by the present invention will be described with reference to the figures.

Furthermore, the respective working configurations described below relate to examples involving application to chemical mechanical polishing as an example of polishing. However, it goes without saying that the present invention can also be applied to a simulation method and apparatus, polishing method and apparatus or polishing system, etc., relating to other polishing and grinding, other abrasive grain polishing, and various other types of polishing, so that the respective working configurations described below can be appropriately modified in accordance with the desired polishing content.

[Principle of the Present Invention

Figure 13:
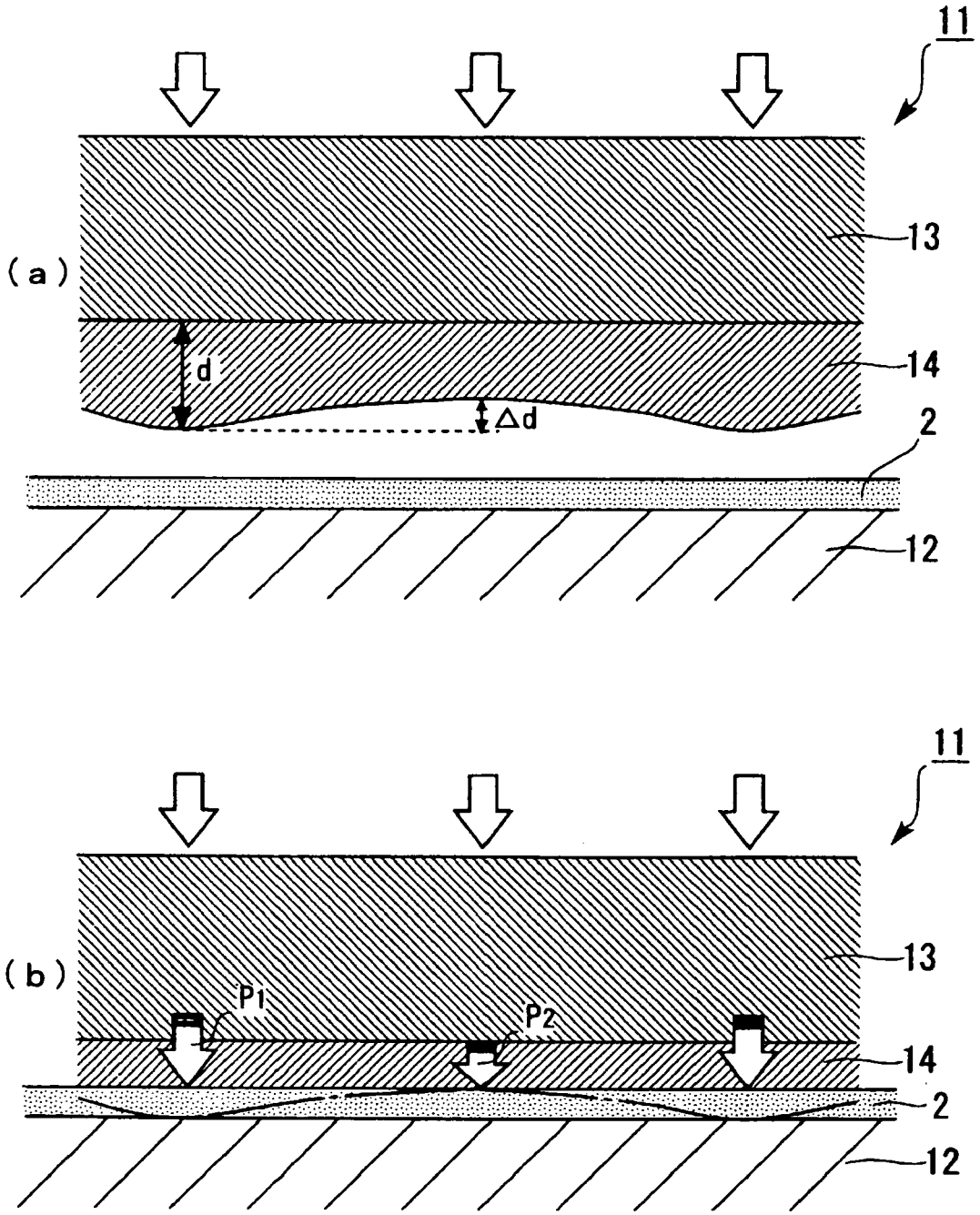
FIG. 13 is an explanatory diagram which shows in model form the principle of the present invention.

The principle of the present invention will be described before working configurations of the present invention are described. FIG. 13 is an explanatory diagram which shows in model form the principle of the present invention, and corresponds to an enlarged sectional view of the essential parts shown in FIG. 1. In FIG. 13, elements that are the same as in FIG. 1 (described later) or that correspond to such elements are labeled with the same symbols.

In FIG. 13, 14 indicates a polishing pad used as a polishing body which constitutes a polishing tool 11, and 13 indicates a flat-plate-form substrate consisting of a rigid body which constitutes the polishing tool 11; A polishing head is constructed from these parts. The upper surface of the polishing pad 14 is pasted to the undersurface of the substrate 13, and the undersurface of the polishing pad 14 constitutes a polishing surface. Specifically, the surface of the polishing pad 14 on the opposite side from the polishing surface is supported by the substrate. Although the undersurface of the substrate 13 in this example is a flat surface, in the present invention, the undersurface of the substrate 13 may also be formed, for example, by a curved surface, etc. The polishing tool 11 has a universally known pressure applying mechanism, and is constructed so that (for example) a load created by the fluid pressure of air, etc., can be applied in a downward direction to the upper surface of the substrate 13. For example, a sheet-form foam polyurethane, or a non-foam resin which has a groove structure in its surface, etc., can be used as the polishing pad 14, and the polishing pad is an elastic body. The polishing pad 14 may also consist of two or more layers rather than a single layer. Furthermore, in FIG. 13, 2 indicates a process wafer used as the object of polishing, and 12 indicates a wafer holder that holds the wafer 2.

Here, a case will be considered in which the polishing surface of the polishing pad 14 has been planed away by the dressing, etc., of the polishing pad 14 so that the surface shape of the polishing surface of the polishing pad 14 (when no pressure is applied to the polishing pad 14) is as shown (for example) in FIG. 13(*a*). The thickness of the protruding portions of the polishing pad 14 when no pressure is applied is designated as d, and the elastic constant (which can be converted into Young's modulus) in the direction of thickness of the polishing pad 14 is designated as k. The effective load P2 that is applied to the wafer 2 in indented portions that are indented by a distance of Δd in the polishing pad 14 from the above-mentioned protruding portions will be considered in terms of a simple system. When a load is applied in the downward direction to the upper surface of the substrate 13, the undersurface (polishing surface) of the polishing pad 14 is pressed against the wafer 2, and the polishing pad 14 is elastically deformed so that this pad assumes the state shown in FIG. 13(*b*). If the effective load input that is applied to the wafer 2 in the above-mentioned protruding portions of the polishing pad 14 is designated as P1, then the amount of deformation of the polishing pad 14 in the above-mentioned protruding portions of the polishing pad 14 is P1/k. If it is assumed that a load is uniformly applied in a downward direction to the upper surface of the polishing pad 14 in all locations, then the effective load P2 that is applied to the wafer 2 in the above-mentioned indented portions is as indicated by the following equation (2):

$$P2=(P1-k\Delta d)d/(d-\Delta d) \quad (2)$$

It is seen from the above description that the effective load that is applied in finely divided individual separate regions of the polishing pad 14 differs according to the indentations and protrusions (Δd) in the polishing surface and the thickness d of the polishing pad 14 when no pressure is applied. Accordingly, if the amount of polishing is predicted (as in conventional methods) by applying the equation of Preston indicated by equation (1) with the assumption being made that the load applied to the upper surface of the substrate 13 is applied "as is" to the wafer 2 regardless of the indentations and protrusions (Δd) in the polishing surface and the thickness d of the polishing pad when no pressure is applied, the predicted amount of polishing will deviate from the actual amount of polishing.

It is seen from the above description that since the elastic constant k is already known, the effective load applied to finely divided individual separate regions of the polishing pad 14 can be calculated by means of equation (2) from the indentations and protrusions (Δd) in the polishing surface and the thickness d of the polishing pad 14 when no pressure is applied. The indentations and protrusions (Δd) in the polishing surface and the thickness d of the polishing pad 14 when no pressure is applied can be ascertained from the height distribution of the polishing surface of the polishing pad 14 with reference to the substrate 13 when no pressure is applied. Accordingly, the effective load applied to finely divided individual separate regions of the polishing pad 14 can be calculated from this height distribution. If the amount of polishing is predicted by applying the equation of Preston shown in equation (1) with the assumption being made that the effective load that is thus calculated is the load that is applied to the wafer 2, then the precision of the predicted amount of polishing is increased. This is the basic principle of the present invention.

In the above description, the principle of the present invention was described using a simple system. If necessary, however, the effective load may also be calculated from the above-mentioned height distribution using another system employing equations of the balance of resultant forces or equations of the balance of moments, etc., based on the deformation according to the elasticity and viscoelasticity of the polishing pad 14. Furthermore, in the above description, it was assumed that the load was uniform (as was described above); in actuality, however, it is desirable to calculate the effective load applied to finely divided individual separate regions of the polishing pad 14 while also taking into account the effect of a biased load resulting from the inclination of the polishing head, etc. In this case, for example, the load in the separate regions and the resulting displacement of the pad is adjusted by repeated calculations to the most appropriate values for obtaining values at which the balance of the above-mentioned resultant forces and moments is established.

[First Working Configuration]

Figure 1:
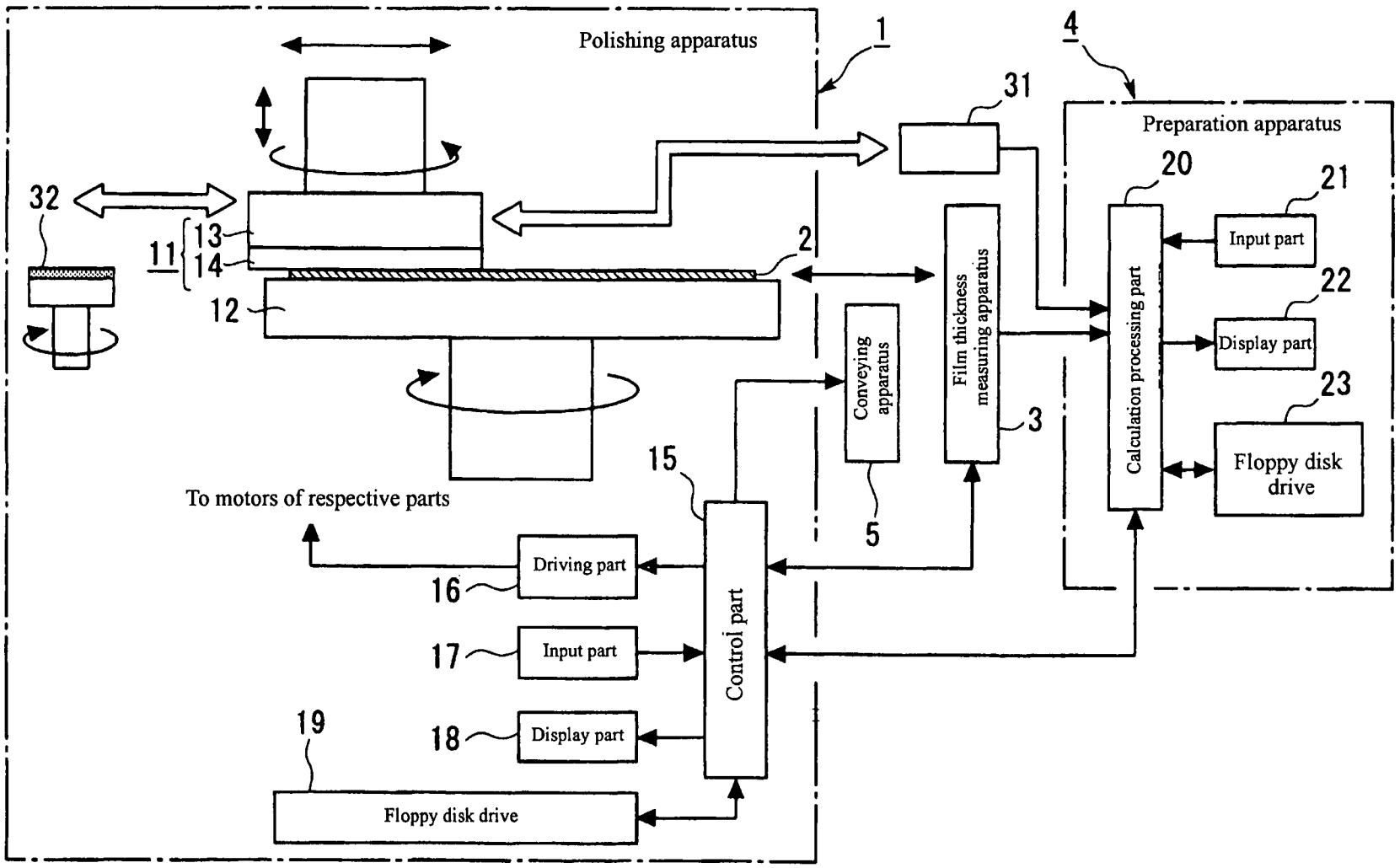
FIG. 1 is a schematic structural diagram which shows in model form a polishing system constituting a first working configuration of the present invention.
Figure 2:
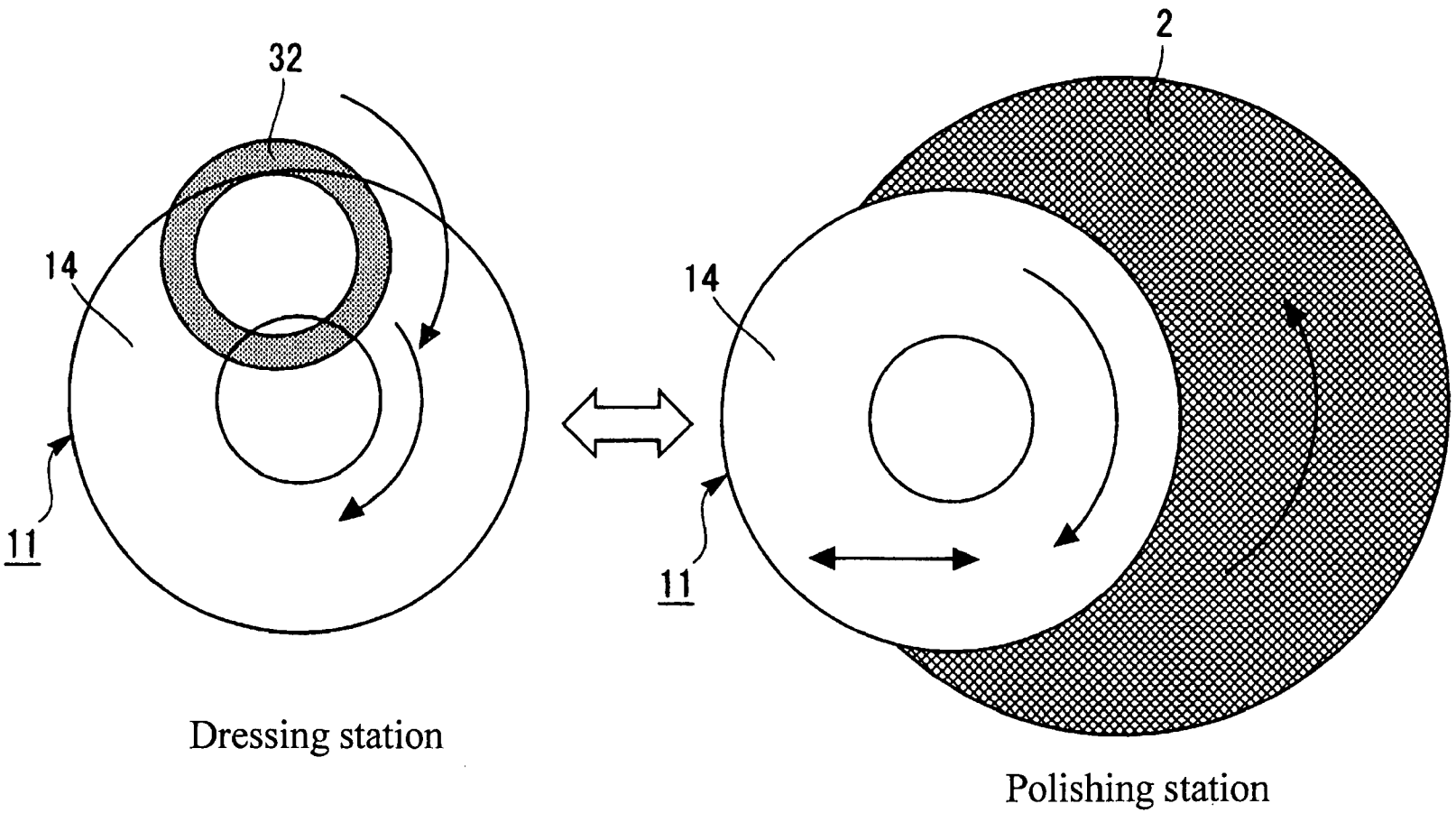
FIG. 2 is a schematic plan view which shows in model form the conditions during the polishing of the wafer and during the dressing of the polishing pad.
Figure 3:
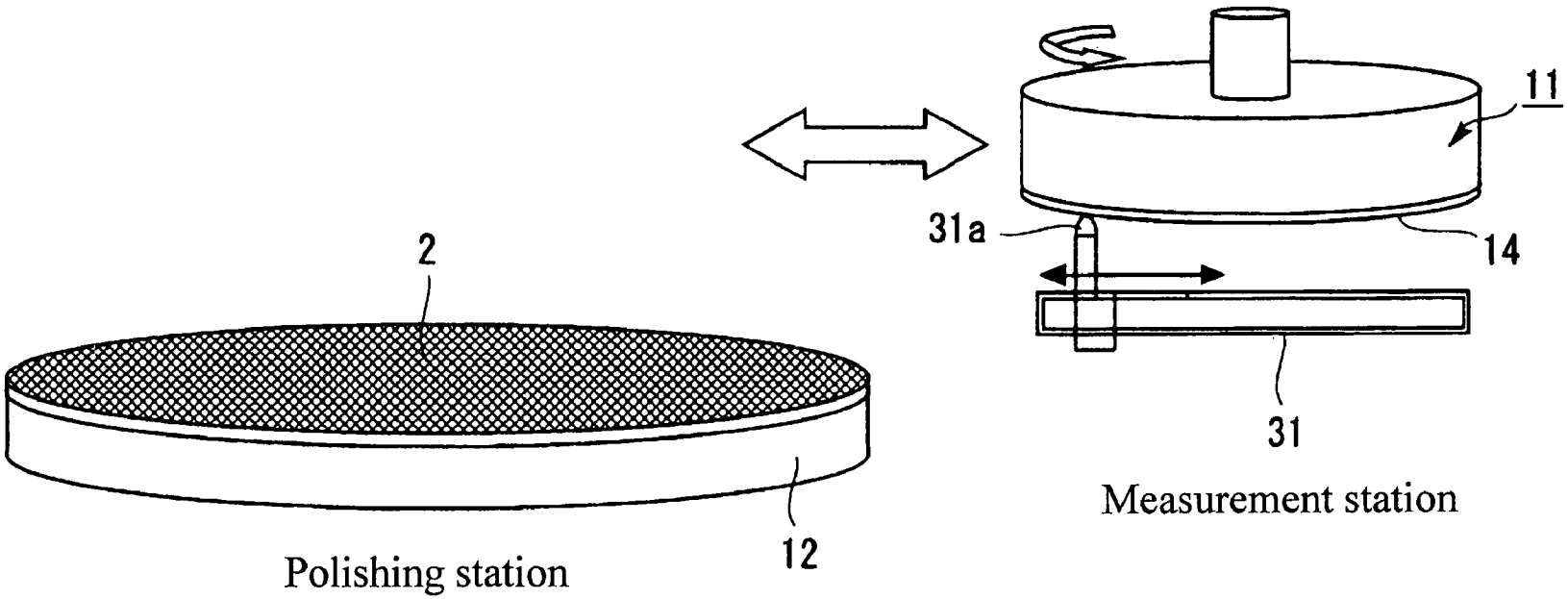
FIG. 3 is a schematic plan view which shows in model form the conditions during the measurement of the height distribution of the polishing surface of the polishing pad with reference to the substrate when no pressure is applied to the polishing pad.
Figure 4:
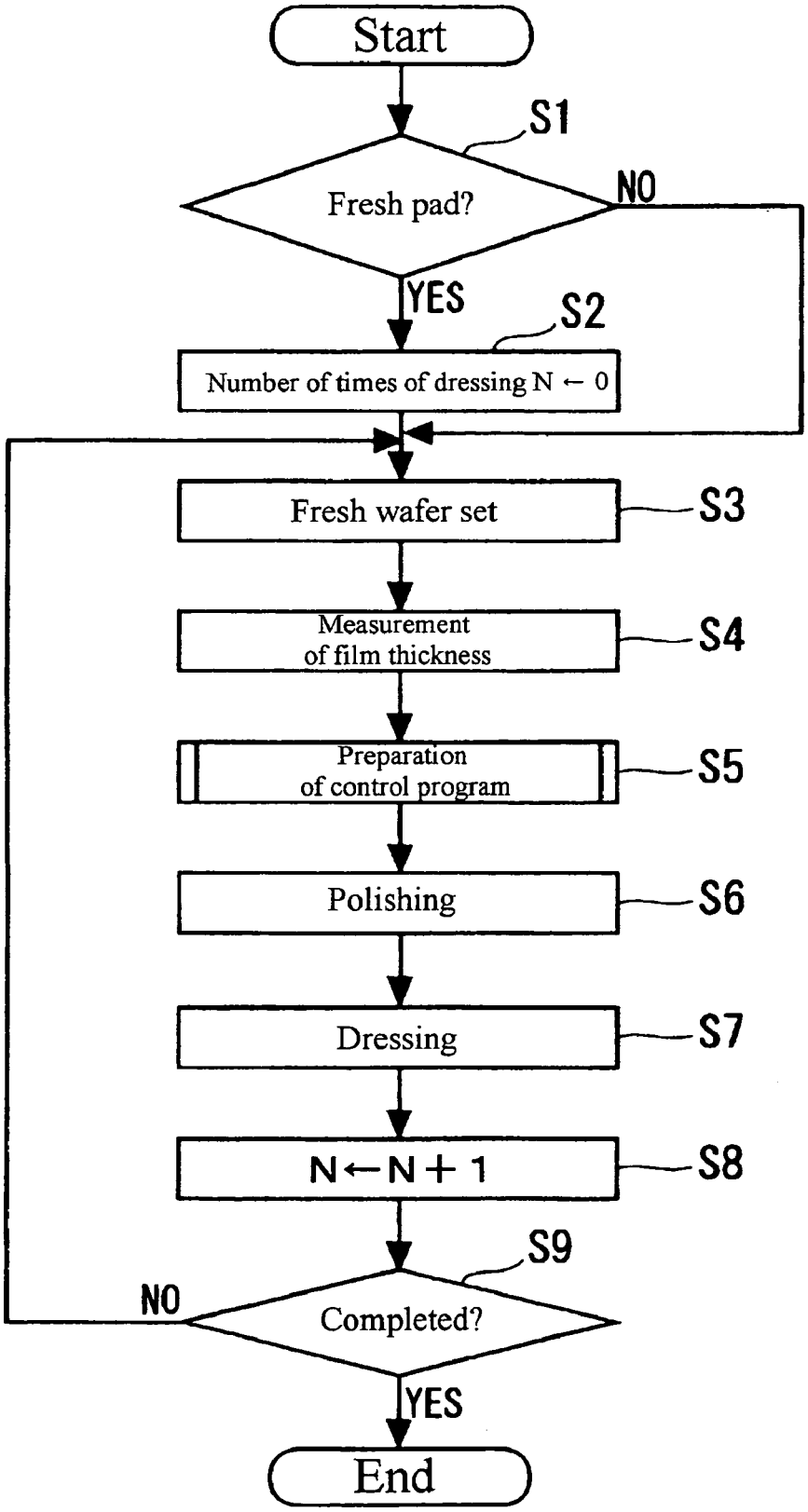
FIG. 4 is a schematic flow chart which shows the operation of the polishing system constituting a first working configuration of the present invention.
Figure 5:
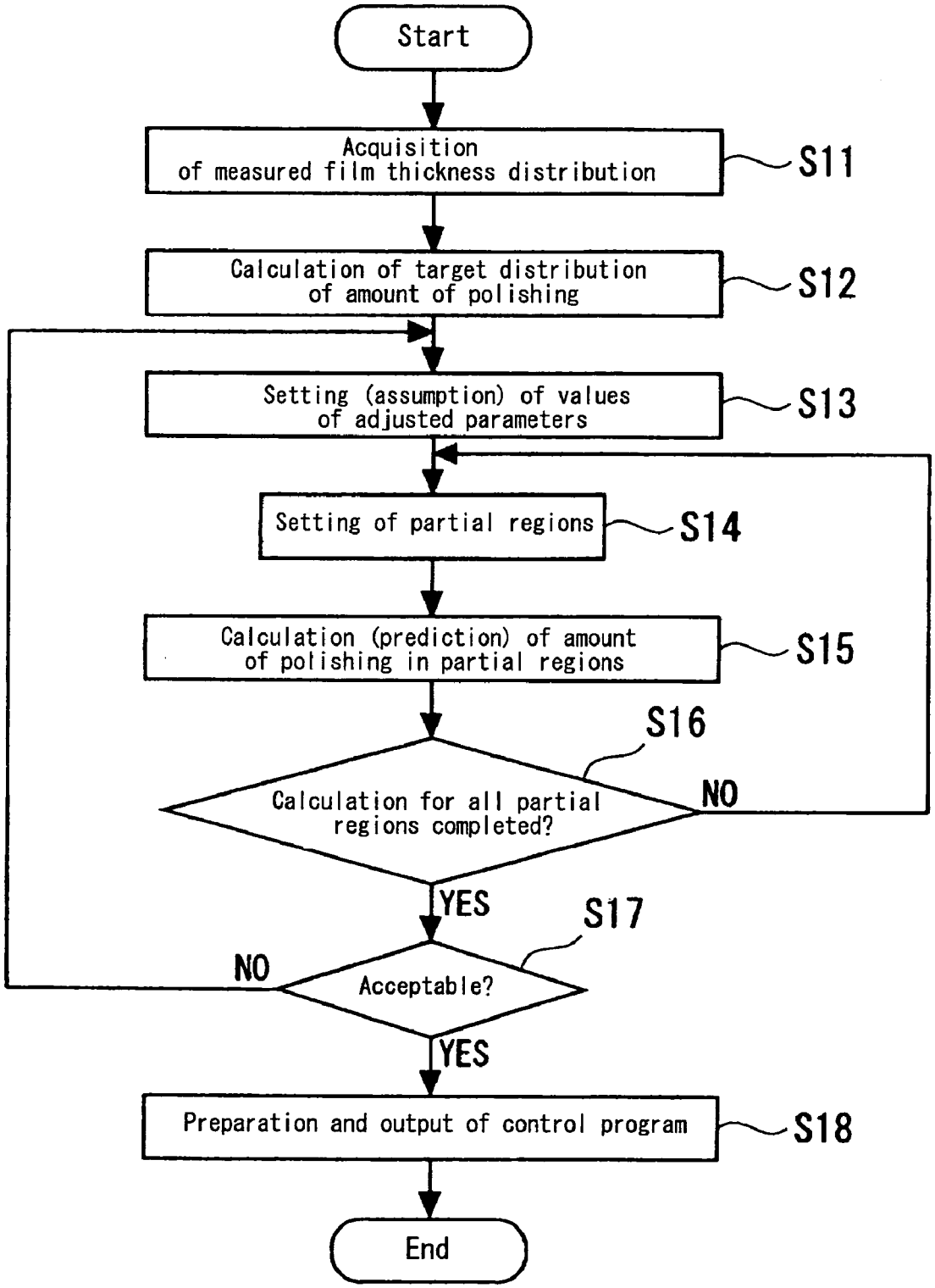
FIG. 5 is a schematic flow chart which shows the content of the processing of step S5 in FIG. 4.

Next, a polishing system constituting a first working configuration of the present invention will be described. FIG. 1 is a schematic structural diagram which shows in model form a polishing system constituting a first working configuration of the present invention. FIG. 2 is a schematic plan view which shows in model form the conditions during the polishing of the wafer 2 and during the dressing of the polishing pad 14. FIG. 3 is a schematic plan view which shows in model form the conditions during the measurement of the height distribution of the polishing surface of the polishing pad 14 with reference to the substrate 13 when no pressure is applied to the polishing pad 14. FIG. 4 is a schematic flow chart which shows the operation of the polishing system of the present working configuration. FIG. 5 is a schematic flow chart which shows the processing content of step S5 in FIG. 4.

As is shown in FIG. 1, the polishing system of the present working configuration comprises a polishing apparatus 1 which performs chemical mechanical polishing on a process wafer 2 used as an object of polishing, a measuring apparatus 3 which measures the film thickness distribution on the side of the polished surface of the wafer 2 (or the shape of the polished surface of the wafer 2) before polishing or after polishing, a preparation apparatus 4 which prepares control parameters or a control program used to control the polishing apparatus 1, a conveying apparatus 5 which conveys the wafer 2 between the measuring apparatus 3 and the surface of a wafer holder 12, etc., and a displacement meter 31 which is used as a measuring apparatus that measures the height distribution of the polishing surface of the polishing pad 14 with reference to the substrate 13 when no pressure is applied to the polishing pad 14 (hereafter referred to simply as the "height distribution"). In the present working configuration, the displacement meter 31 is disposed in a measurement station (measurement zone).

The polishing apparatus 1 comprises a polishing tool 11, a wafer holder 12 which holds the wafer 2 on the underside of the polishing tool 11 positioned in the polishing station (polishing zone), a polishing agent supply part (not shown in the figures) which supplies a polishing agent (slurry) to the area between the wafer 2 and the polishing tool 11 via a supply path (not shown in the figures) formed in the polishing tool 11, a dresser (dressing tool) 32 which is disposed in a dressing station (dressing zone) and which dresses the polishing surface of the polishing pad 14 of the polishing tool 11 positioned in the dressing station, a control part 15 comprising a computer, etc., a driving part 16 which drives the motors of various parts under the control of the control part 15, an input part 17 such as a keyboard, a display part 18 such as a CRT, and a flexible disk drive 19 which performs the reading and writing of data on a flexible disk used as a recording medium.

As was described above, the polishing tool 11 has a polishing pad 14 and a substrate 13 which supports the surface of the polishing pad 14 on the side opposite the polishing surface. In the present working configuration, as is shown in FIG. 2, the shape of the polishing pad 14 is a ring-form shape in which the portion in the vicinity of the center of rotation has been removed. However, the present invention is not limited to such a shape. The polishing tool 11 is devised so that this polishing tool can be caused to perform a rotational motion, an upward and downward motion and a swinging motion (reciprocating motion) in the left-right direction as indicated by the arrows in FIG. 1 by a mechanism (not shown in the figures) which uses electric motors as actuators. Furthermore, as is shown in FIGS. 1 through 3, the polishing tool 11 is devised so that this polishing tool 11 can be moved to the polishing station, dressing station and measurement station by a moving mechanism (not shown in the figures) using an electric motor as an actuator.

The wafer 2 is held on a wafer holder 12, and the upper surface of the wafer 2 is the polished surface. The wafer holder 12 is devised so that this wafer holder 12 can be caused to rotate as shown by the arrow in FIG. 1 by a mechanism (not shown in the figures) which uses an electric motor as an actuator.

In the present working configuration, the diameter of the polishing tool 11 is set at a diameter that is smaller than the diameter of the wafer 2, so that the footprint of the apparatus as a whole is small, and so that high-speed low-load polishing is facilitated. Of course, in the present invention, the diameter of the polishing tool 11 may be the same as or larger than the diameter of the wafer 2.

Here, the polishing of the wafer 2 by this polishing apparatus 1 will be described. The polishing tool 11 swings while rotating, and is pressed against the upper surface of the wafer 2 on the wafer holder 12 by a specified pressure (load). The wafer holder 12 is caused to rotate so that the wafer 2 is also caused to rotate, thus causing a relative motion to be performed between the wafer 2 and the polishing tool 11. In this state, a polishing agent is supplied to the area between the wafer 2 and the polishing tool 11 from the polishing agent supply part, and this polishing agent diffuses between these two parts, so that the polished surface of the wafer 2 is polished. Specifically, mechanical polishing caused by the relative motion of the polishing tool 11 and wafer 2 and the chemical action of the polishing agent act synergistically so that favorable polishing is performed.

The dresser 32 is devised so that this dresser 32 can be caused to rotate as indicated by the arrows in FIGS. 1 and 2 by a mechanism (not shown in the figures) which uses an electric motor as an actuator. In the present working configuration, as is shown in FIG. 2, the shape of the dresser 32 is a ring-form shape in which the portion in the vicinity of the center of rotation has been removed. However, the present invention is not limited to such a shape. Abrasive grains are distributed on the surface of the dresser 32; as is shown in the right-side portion of FIG. 2, the polishing pad 14 of the polishing tool 11 positioned in the dressing station is pressed against the dresser 32 in a state in which a load is applied, and the dresser 32 and polishing tool 11 are respectively caused to rotate as indicated by the arrows in FIG. 2, so that dressing of the polishing pad 14 is accomplished in the same manner as polishing. Of course, the dressing of the polishing pad 14 is not limited to such a treatment.

In the present working configuration, as is shown in FIG. 3, a commercially marketed contact needle-type displacement meter is used as the displacement meter 31. In this displacement meter 31, a contact needle 31*a* contacts the polishing surface of the polishing pad 14 and moves upward or downward in accordance with the height of this polishing surface, so that the height distribution of the polishing pad 14 can be measured by sliding the contact needle 31*a* in the radial direction of the polishing pad 14. Furthermore, since the height of the polishing pad 14 at every position on a circle of the same radius is substantially the same, it is sufficient merely to measure the height at respective positions on a line that is oriented along a certain radius of the polishing pad 14. For example, an optical-type displacement meter (shown in FIG. 11 described later) may also be used as the displacement meter 31 instead of the above-mentioned contact needle-type displacement meter.

In order to realize the above-mentioned polishing operation in accordance with the control parameters or control program supplied from the preparation apparatus 4, the control part 15 controls via a driving part 16 the respective motors used for the rotation, upward and downward motion and swinging of the polishing tool 11, as well as the motor used for the rotation of the wafer holder 12, and controls other respective parts not shown in the figures. Furthermore, the control part 15 also controls the movement of the polishing tool 11 to the respective stations, and the dresser 32. Moreover, in the present working configuration, the control part 15 also functions as a comprehensive control part for the overall polishing system, so that the preparation apparatus 4, measuring apparatus 3, conveying apparatus 5 and displacement meter 31 are also controlled by the control part 15.

The input part 17 is used by the operator to input various types of commands, etc., and required data, etc. The display part 18 displays an input guide display, etc., under the control of the control part 15. The flexible disk drive 19 reads in control parameters or control programs from a flexible disk on which these control parameters, etc., are recorded, and supplies these control parameters, etc., to the control part 15 as required.

If the film on the side of the polished surface of the wafer 2 is an $SiO_2$ film, etc., a light interference-type film thickness measuring apparatus, for example, can be used as the measuring apparatus 3. If the film on the side of the polished surface of the wafer 2 is a metal film consisting of Cu, etc., then an electrical resistance-type film thickness measuring apparatus, for example, can be used as the measuring apparatus 3. Furthermore, in the present working configuration, a film thickness measuring apparatus which can measure the film thickness distribution is used as the measuring apparatus 3.

The preparation apparatus 4 comprises a calculation processing part 20 consisting of a computer, etc., an input part 21 such as a keyboard, a display part 22 such as a CRT, and a flexible disk drive 23 which reads and writes data on a flexible disk. At the time of introduction, the program recorded on the flexible disk is installed on a hard disk (not shown in the figures) via the drive 23; this enables the calculation processing part 20 to execute the processing shown in FIG. 4 (described later). Accordingly, this flexible disk constitutes a medium on which a program used to execute the processing shown in FIG. 4 is recorded. Such a program can also be sent to the preparation apparatus 4 via the internet, etc. This point is the same in regard to respective working configurations described below. Furthermore, it goes without saying that the calculation processing part 20 and control part 15 may be constructed by the same computer.

Furthermore, the above-mentioned recording medium is not limited to a flexible disk; for example, this recording medium may also be a CD-R, MO or DVD, etc. In such cases, it goes without saying that a drive corresponding to the recording medium used is employed instead of the drive 23. This point is also the same in regard to the above-mentioned flexible disk drive 19, and in regard to respective working configurations described below.

Next, the operation of the polishing system constituting the present working configuration will be described with reference to FIG. 4. In this polishing system, when operation is initiated, the following operation is performed under the control of the control part 15. First, the control part 15 judges whether or not the polishing pad 14 mounted on the polishing tool 11 is a fresh polishing pad (a polishing pad that has not yet performed polishing of the wafer 2, and that has not yet been dressed) (step S1). For example, this judgement is made according to whether or not the operator has previously performed an input operation from the input part 17 indicating that the polishing pad 14 is fresh. If the polishing pad is fresh, the control part 15 resets the count value N of the number of times of dressing (number of dressing processes) to zero in its internal memory (step S2), and then proceeds to step S3. On the other hand, if it is judged in step S1 that the polishing pad is not a fresh polishing pad, since the number of times of dressing N is already stored in the above-mentioned memory, the control part 15 proceeds "as is" to step S3.

In step S3, the conveying apparatus 5 conveys a fresh wafer 2 that is to be polished from a specified location to the measuring apparatus 3, and sets this wafer in the measuring apparatus 3 (step S3). Afterward, the measuring apparatus 3 measures the film thickness distribution on the side of the polished surface of the wafer 2, and the measurement results are automatically input into the calculation processing part 20 of the preparation apparatus 4 (step S4). Furthermore, when the measurement performed by the measuring apparatus 3 is completed, the conveying apparatus 5 conveys the wafer 2 for which this measurement has been completed from the measuring apparatus 3 to the surface of the wafer holder 12 of the polishing apparatus 1.

Next, the preparation apparatus 4 prepares the above-mentioned control program or control parameters on the basis of the initial film thickness distribution constituting the measurement results from the measuring apparatus 3, and the prepared control program or control parameters are automatically output to the control part 15 (step S5). Afterward, the control part 15 performs control in accordance with the input control program or control parameters, and the polishing apparatus 1 polishes the polished surface of the wafer 2 (step S6). When this polishing is completed, the polished wafer 2 is conveyed to a specified location by the conveying apparatus 5, and the polishing tool 11 moves to the dressing station, where the polishing pad 14 is dressed by the above-mentioned dressing operation. Next, the control part 15 increases the count of the number of times of dressing N stored in its internal memory by one (step S8), and judges whether or not polishing of the specified number of wafers has been completed (step S9). If this polishing has not been completed, the processing returns to step S3, and the subsequent operations are repeated; if the polishing has been completed, this series of operations is ended.

Here, the content of the processing of step S5 in FIG. 4 will be described with reference to FIG. 5.

Furthermore, prior to the processing of step S5, the values of those parameters among the polishing conditions that are treated in a fixed manner during simulation (called "fixed parameters") and the types of parameters among the polishing conditions whose values are adjusted during simulation (called "adjusted parameters") are input by the input part 21. These data are stored in the internal memory (not shown in the figures) of the calculation processing part 20. For instance, examples of fixed parameters include the type of film on the side of the polished surface of the wafer 2, the type of slurry used, the type of material of the polishing pad 14, the structure of the polishing pad 14 (groove pattern, etc.), the diameter of the polishing pad 14 and the diameter of the wafer 2, etc. Furthermore, examples of adjusted parameters include the rpm of the polishing tool 11, the rpm of the wafer 2 and the swinging pattern (speed, stroke, starting position of swinging, etc.) of the polishing tool 11, etc. Incidentally, among the parameters cited as adjusted parameters, the values of the rpm of the polishing tool 11 and the rpm of the wafer 2, for example, may also be input beforehand as fixed parameters.

Furthermore, prior to the processing of step S5, the relationship between the number of times that dressing is performed on the polishing pad 14 and the height distribution of the polishing pad 14 is stored in the internal memory of the calculation processing part 20 in the form of a look-up table or in the form of an equation in accordance with the material and structure (groove structure), etc., of the polishing pad 14. This relationship may be a relationship that is determined beforehand by experiment (specifically, this may be a relationship that is determined by actually dressing the polishing pad 14 under the same dressing conditions as in step S7, and measuring the height distribution of the polishing pad 14 by means of the displacement meter 31 for each number of times of dressing). Moreover, in the present working configuration, since the polishing pad 14 is dressed by a treatment similar to polishing, the height distribution of the polishing pad 14 can be predicted with good precision according to the equation of Preston shown in equation (1) without actually dressing the polishing pad 14 (the present inventor has confirmed this by experiment). Accordingly the above-mentioned relationship stored in the internal memory of the calculation processing part 20 may also be a relationship that is determined on the basis of the above-mentioned height distribution of the polishing pad 14 predicted according to the equation of Preston in accordance with the number of times of dressing.

Since the fluctuation in the height distribution of the polishing pad 14 that accompanies the progress of dressing is reproducible in cases where dressing is performed under the same dressing conditions, the number of times of dressing can serve as an indicator of the above-mentioned height distribution of the polishing pad 14 that accompanies the progress of dressing. Similarly, the accumulated dressing time can also serve as an indicator of the above-mentioned height distribution of the polishing pad 14 that accompanies the progress of dressing. Furthermore, the number of times of polishing or the accumulated polishing time can also serve as an indicator of the above-mentioned height distribution of the polishing pad 14 that accompanies the progress of polishing. The fluctuation in the height distribution of the polishing pad 14 caused by dressing is fairly large compared to the fluctuation in the height distribution of the polishing pad 14 caused by polishing. Accordingly, even the number of times of dressing or the cumulative dressing time alone is a precise indicator of the height distribution of the polishing pad 14. However, a combination of the number of times of dressing or cumulative dressing time and the number of times of polishing or cumulative polishing time is a much more precise indicator of the height distribution of the polishing pad 14. Considering this point, for example, the relationship between the height distribution of the polishing pad 14 and a combination of the number of times that dressing is performed on this polishing pad 14 and the number of times that a polishing process is performed using this polishing pad 14 may be stored in the internal memory of the calculation processing part 20. In this case, in the present working configuration, since the number of times of dressing equals the number of times of polishing, the measured values of the height distribution of the polishing pad 14 following the performance of dressing and polishing N times each may be stored in the internal memory of the calculation processing part 20 in association with N indicating the number of times of dressing and number of times of polishing.

When the processing of step S5 is initiated, the calculation processing part 20 of the preparation apparatus 4 first acquires the measurement results for the film thickness distribution that are sent from the measuring apparatus 3, and stores these results in the internal memory of the calculation processing part 20 (step S11).

Next, the calculation processing part 20 calculates the target distribution of the amount of polishing on the basis of the measurement results for the film thickness distribution (step S12). The target distribution of the amount of polishing is the distribution of the amount of polishing of the above-mentioned polished surface that is required in order to obtain the desired film thickness distribution.

Next, the calculation processing part 20 sets (or assumes) the values (or sets of values) of the adjusted parameters at certain values (or sets of values) (step S13). As a result, an assumption of control parameters or a control program is made.

Then, the calculation processing part 20 sets one partial region among individual partial regions of the polished surface of the wafer 2 as the object of processing (step S14). Next, for the partial region set in step S14, the calculation processing part 20 calculates the effective load, relative contact speed and polishing time (contact time) of this partial region on the basis of the values of the fixed parameters stored in the internal memory and the adjusted parameters set in step S13. In this case, when the calculation processing part 20 calculates the effective load of the above-mentioned partial region, the calculation processing part 20 reads out the most recent number of times of dressing N stored in the internal memory of the control part 15, and obtains the height distribution of the polishing pad 14 corresponding to this number of times of dressing N in accordance with the above-mentioned equation or above-mentioned look-up table stored beforehand in the internal memory of the calculation processing part 20. Then, on the basis of this height distribution, the effective load of the above-mentioned partial region is calculated (for example) in accordance with the above-mentioned equation (2) or in accordance with an equation in which the effect of a biased load is added to this distribution. Then, the calculation processing part 20 calculates (predicts) the amount of polishing from the effective load, relative contact speed and polishing time (contact time) of the above-mentioned partial region according to equation (1) (step S15).

Next, the calculation processing part 20 makes a judgement as to whether or not the calculation of the amount of polishing has been completed for all of the partial regions of the polished surface of the wafer 2 (step S16). If this calculation has not been completed, the processing returns to step S14. On the other hand, if the calculation has been completed, the processing proceeds to step S17. In this case, the distribution of the amount of polishing of the polished surface of the wafer 2 is obtained. Steps S14 through S16 correspond to the function of prediction means (simulation means) for predicting the distribution of the amount of polishing of the polished surface of the wafer 2.

In step S17, the calculation processing part 20 judges the acceptability of the most recent values (or sets of values) of the adjusted parameters set in step S13, i.e., the acceptability of the assumed control parameters or control program, by comparing the predicted distribution of the amount of polishing of the polished surface of the wafer 2 with the target distribution of the amount of polishing calculated in step S12, and by determining whether or not specified standards are met.

If a judgement of "unacceptable" is made in step S17, the processing returns to step S13. In this case, values which are at least partially altered with respect to the values (or sets of values) set in step S13 up to the previous time are set in step S13.

On the other hand, if a judgement of "acceptable" is made in step S17, the calculation processing part 20 prepares, on the basis of the most recent values (or sets of values) of the adjusted parameters set in step S13, and if necessary, the fixed parameters stored in the internal memory, the control parameters or control program for controlling the polishing apparatus 1 that are required in order to achieve the polishing conditions indicated by these adjusted parameters and/or fixed parameters, and sends these control parameters or control program to the control part 15 of the polishing apparatus 1 (step S18). With this, the processing of step 5 in FIG. 4 is ended.

In the present working configuration, as a result of such an operation, the control part 15 controls the polishing operation of the wafer 2 in accordance with different control parameters or a different control program according to the indicator that indicates the height distribution of the polishing pad 14 (in the present working configuration, the number of times of dressing N).

In the present working configuration, in step S15 shown in FIG. 5, the preparation apparatus 4 predicts the amount of polishing (following the polishing of the wafer 2) for individual partial regions of the polished surface of the wafer 2 using as one of the parameters an indicator that indicates the height distribution of the polishing pad 14 (i.e., the number of times of dressing N in the present working configuration) in accordance with the above-mentioned principle of the present invention. Accordingly, the amount of polishing in the partial regions of the polished surface of the wafer 2 can be predicted with good precision. As a result, the precision of the prediction of the distribution of the amount of polishing of the polished surface of the wafer 2 that is performed in steps S14 through S16 in FIG. 5 is also increased. Accordingly, optimization of the polishing conditions (control parameters of the polishing apparatus, etc.) can be achieved with good efficiency. As a result, the process as a whole can be made more efficient. Furthermore, since the polishing apparatus 1 is operated in accordance with the control parameters or control program prepared by the preparation apparatus 4, the desired film thickness distribution of the wafer 2 can be obtained with good precision, so that a high degree of flatness can be ensured. In the present working configuration, furthermore, the above-mentioned effect can be obtained even if the dressing process of step S6 is performed without flatness of the polishing surface of the polishing pad 14 being strictly obtained.

Moreover, in the present working configuration, since the measuring apparatus 3, preparation apparatus 4, displacement meter 31 and polishing apparatus 1 construct a polishing system as a whole, measurement, preparation of control parameters, etc., and polishing can be performed in a single operation.

Furthermore, in the present working configuration, since the input of the measurement results from the measuring apparatus 3 into the preparation apparatus 4 and the input of the control parameters or control programs prepared by the preparation apparatus 4 into the polishing apparatus 1 are performed automatically, the burden on the operator is eliminated, and by extension, the efficiency of the polishing process as a whole can be increased to a much greater extent. Furthermore, it is also possible to arrange the polishing system so that the above-mentioned respective inputs are performed in accordance with commands from the input part 17 or input part 21.

[Second Working Configuration]

Figure 6:
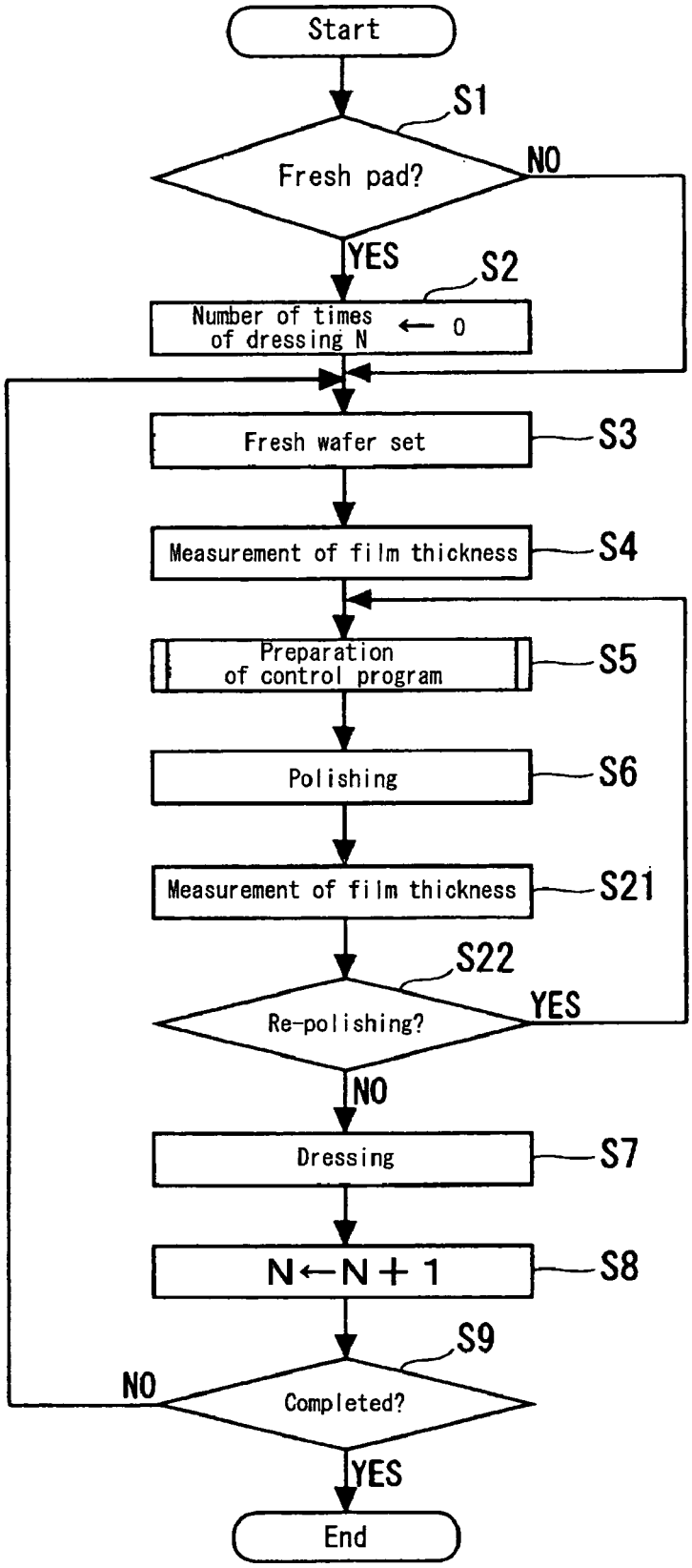
FIG. 6 is a schematic flow chart which shows the operation of a polishing system constituting a second working configuration of the present invention.

FIG. 6 is a schematic flow chart which shows the operation of a polishing system constituting a second working configuration of the present invention. In FIG. 6, steps that are the same as steps in FIG. 4, or that correspond to steps in FIG. 4, are labeled with the same symbols, and a redundant description is omitted.

The present working configuration differs from the above-mentioned first working configuration in the following respects. Specifically, film thickness measurement (step S21) which is the same as that of step S4 is performed following the polishing process (step S6), and a judgement as to whether or not re-polishing is to be performed is made by comparing these measurement results with the desired film thickness distribution on the side of the polished surface of the wafer 2 or the desired shape of the above-mentioned polished surface (step S22). In cases where re-polishing is to be performed, the processing returns to step S5, while in cases where re-polishing is not to be performed, the processing proceeds to step S7.

In the present working configuration, since steps S21 and S22 are provided, steps S5, S6 and S21 can be repeated in cases where the shape or film thickness distribution of the polished surface of the wafer 2 does not have the desired precision following initial polishing, so that the desired shape of the polished surface of the wafer 2 or the desired film thickness distribution on the side of this polished surface can be obtained with much better precision.

[Third Working Configuration]

Figure 7:
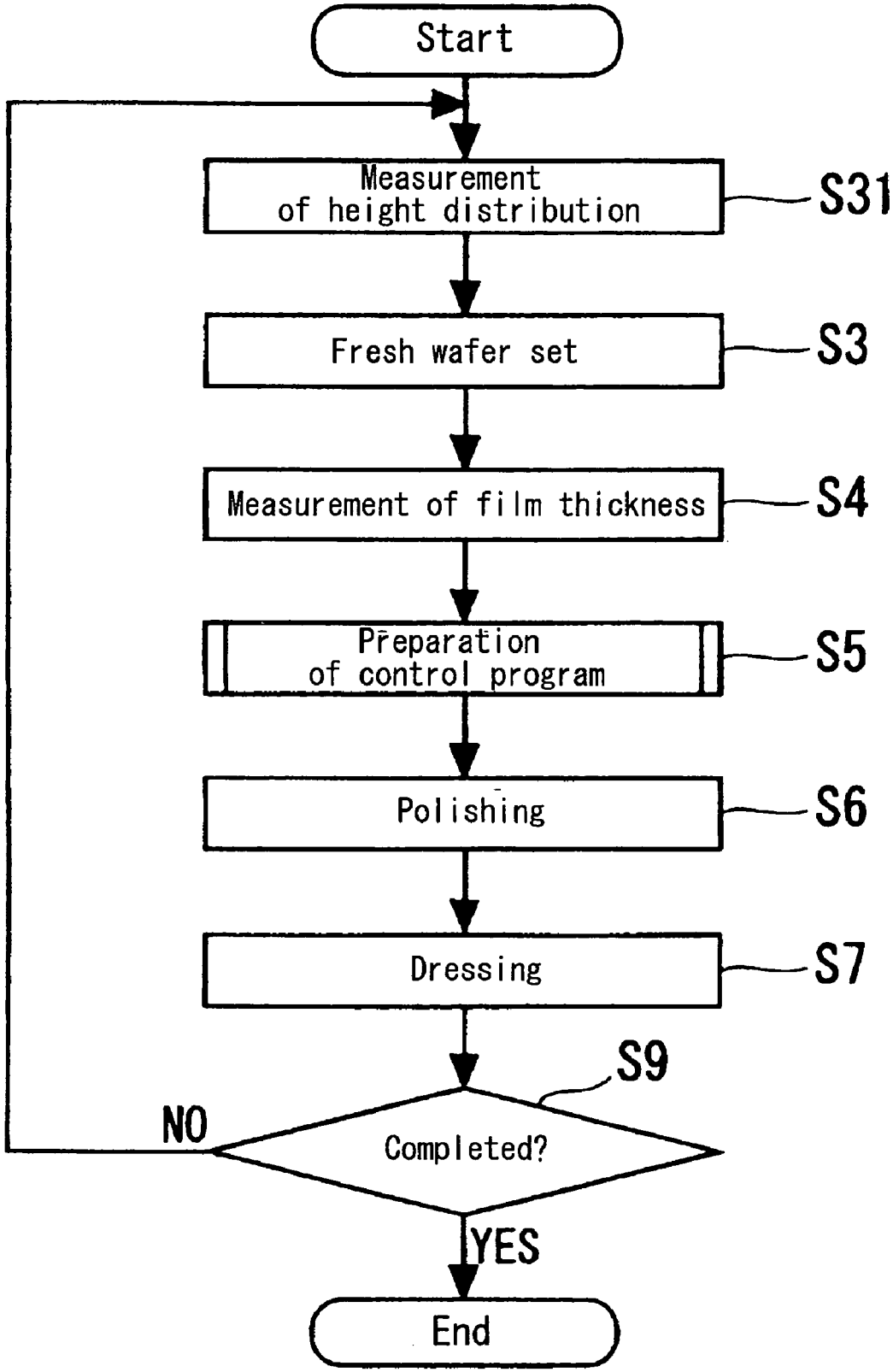
FIG. 7 is a schematic flow chart which shows the operation of a polishing system constituting a third working configuration of the present invention.

FIG. 7 is a schematic flow chart which shows the operation of a polishing system constituting a third working configuration of the present invention. In FIG. 7, steps that are the same as steps in FIG. 4, or that correspond to steps in FIG. 4, are labeled with the same symbols, and a redundant description is omitted.

The present working configuration differs from the above-mentioned first working configuration in the following respects. Specifically, steps S1, S2 and S8 in FIG. 4 are eliminated, and step S31 is added. In the polishing system of the present working configuration, when the operation is initiated, the control part 15 causes the polishing pad 14 to move to the measurement station, and causes the displacement meter 31 to measure the height distribution of the polishing pad 14. These measurement results are input into the calculation processing part 20, and are stored in the internal memory of this calculation processing part 20 (step S31). Afterward, the processing proceeds to step S3. Step S5 in FIG. 7 is basically the same as step S5 in FIG. 4, but differs in the following respects. Specifically, in the present working configuration, in step S15 within step S5 (see FIG. 5), the height distribution of the polishing pad 14 is not acquired by referring to a look-up table or the like stored in the internal memory of the calculation processing part 20 beforehand; instead, the amount of polishing is calculated using the height distribution of the polishing pad 14 most recently measured in step S31. Furthermore, the processing proceeds directly to step S9 following step S7, and in cases where the result is NO in step S9, the processing returns to step S31.

In the present working configuration, since the height distribution of the polishing pad 14 is measured each time, the efficiency drops somewhat compared to the above-mentioned first working configuration; basically, however, the same advantages as those of the first working configuration can be obtained.

[Fourth Working Configuration]

Figure 8:
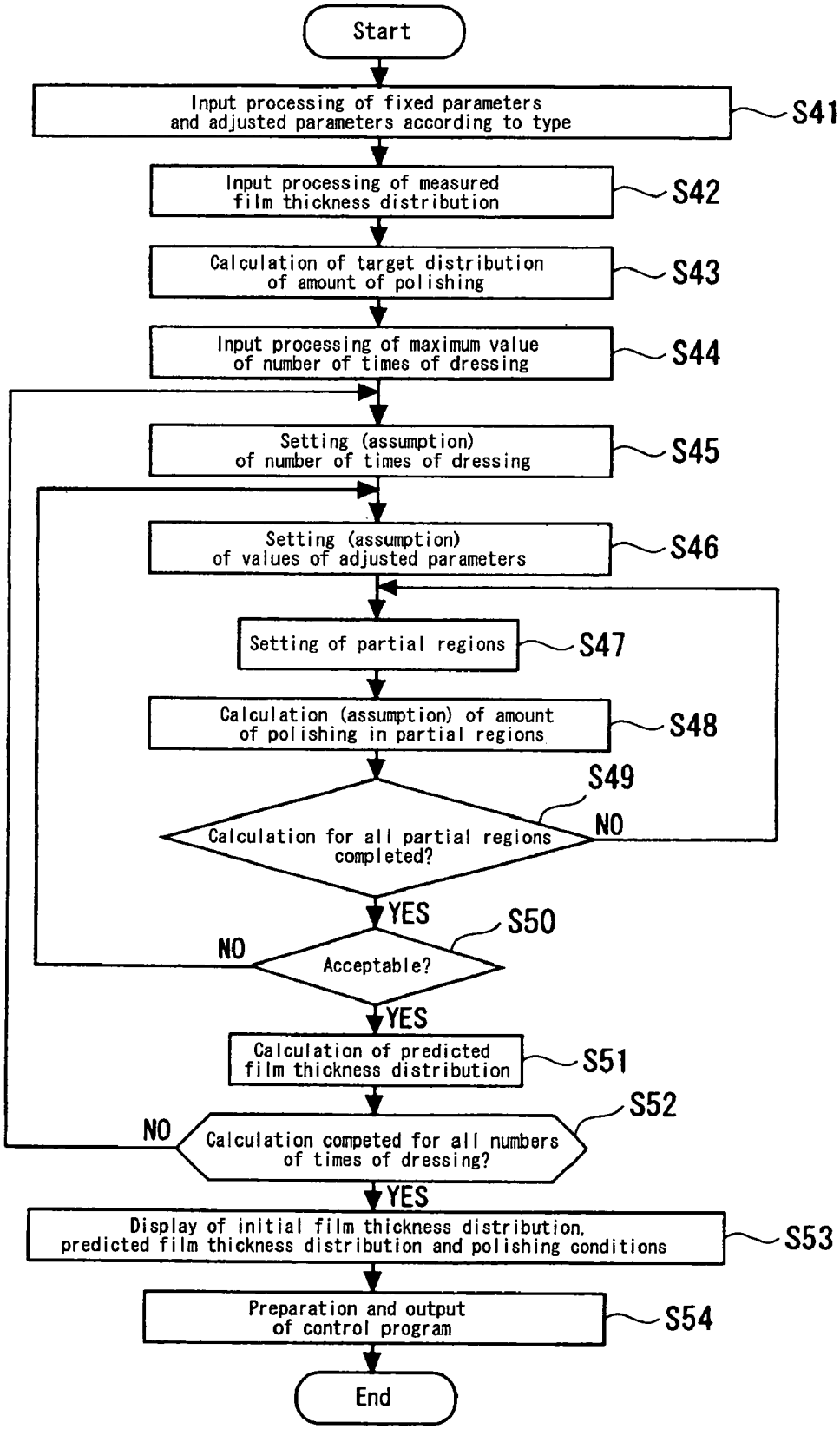
FIG. 8 is a schematic flow chart which shows the operation of a preparation apparatus constituting a fourth working configuration of the present invention.

FIG. 8 is a schematic flow chart which shows the operation of a preparation apparatus constituting a fourth working configuration of the present invention.

The present working configuration is modified so that the preparation apparatus 4 of the polishing system constituting the above-mentioned first working configuration shown in FIG. 1 is separated from the measuring apparatus 3, polishing apparatus 1 and displacement meter 31, and is thus made independent. However, the block diagram which shows the schematic construction of the preparation apparatus constituting the present working configuration in model form is the same as that of the preparation apparatus 4 shown in FIG. 1. Accordingly, reference will also be made to FIG. 1 in the description of the present working configuration. In the present working configuration, however, the line from the measuring apparatus 3 to the calculation processing part 20, the line between the control part 15 and the calculation processing part 20 and the line from the displacement meter 31 to the calculation processing part 20 are eliminated.

In the present working configuration, as in the above-mentioned first working configuration, the relationship between the number of times that dressing is performed on the polishing pad 14 and the height distribution of the polishing pad 14 is stored beforehand in the internal memory of the calculation processing part 20 in the form of a look-up table or the form of an equation in accordance with the material and structure (groove structure), etc., of the polishing pad 14.

When the operation of the preparation apparatus of the present working configuration is initiated, as is shown in FIG. 8, the calculation processing part 20 controls the display part 22 so that this display part 22 is caused to display an input guide display which prompts the operator to input the above-mentioned fixed parameters and the types of the above-mentioned adjusted parameters (step S41). When these data are input via the input part 21, the calculation processing part 20 controls the display part 22 so that the display part 22 is caused to display an input guide display which prompts the operator to input the film thickness distribution of the wafer 2 measured by the measuring apparatus 3 (step S42). When this film thickness distribution is input via the input part 21, the calculation processing part 20 calculates the target distribution of the amount of polishing on the basis of the measurement results for the film thickness distribution input in step S42 (step S43).

Next, the calculation processing part 20 controls the display part 22 so that the display part 22 is caused to display an input guide display which prompts the operator to input the maximum value of the number of times of dressing (step S44). When this maximum value of the number of times of dressing is input via the input part 21, one number of times of dressing that has not yet been set (assumed) among the numbers of times from zero to the input maximum value of the number of times of dressing is set (assumed) (step S45).

Afterward, the calculation processing part 20 performs steps S46 through S50, which respectively correspond to steps S13 through S17 in FIG. 5. However, in step S48, the calculation processing part 20 obtains the height distribution of the polishing pad 14 corresponding to the number of times of dressing N assumed in step S45 according to the above-mentioned equation or above-mentioned look-up table stored beforehand in the internal memory of the calculation processing part 20, and calculates the amount of polishing using this height distribution.

In cases where the result is YES in step S50, the calculation processing part 20 calculates the predicted film thickness distribution of the polished surface of the wafer 2 on the basis of the predicted distribution of the amount of polishing of the polished surface of the wafer 2 used in the judgement made in step S50 and the initial film thickness distribution input in step S42 (step S51).

Then, a judgement is made as to whether or not the processing of steps S46 through S51 has been completed for all of the numbers of times of dressing from zero to the maximum value of the number of times of dressing input in step S44 (step S52). If this processing has not been completed, the processing returns to step S45; if this processing has been completed, the processing proceeds to step S53.

In step S53, the calculation processing part 20 causes the display part 22 to display the predicted distribution of the amount of polishing, predicted film thickness distribution and polishing conditions respectively corresponding to each number of times of dressing, in association with each number of times of dressing from zero to the maximum value of the number of times of dressing (step S53). In this case, the initial film thickness distribution is also displayed.

Next, as in the case of step S18 in FIG. 5, the calculation processing part 20 prepares control parameters or a control program for the purpose of controlling the polishing apparatus 1. Here, however, the control parameters or control program are prepared for each number of times of dressing from zero to the maximum value of the number of times of dressing. Then, the calculation processing part 20 writes the respective control parameters or control program corresponding to each number of times of dressing onto a flexible disk (not shown in the figures) in association with each number of times of dressing via the flexible disk drive 23 (step S54). With this, the operation of the preparation apparatus constituting the present working configuration is ended. The operator may remove this flexible disk from the drive 23 and set the disk in the drive 19 of the polishing apparatus 1, and then give a command to the control part 15 from the input part 17, so that the polishing operation is initiated in accordance with the control parameters or control program recorded on the above-mentioned flexible disk.

Figure 9:
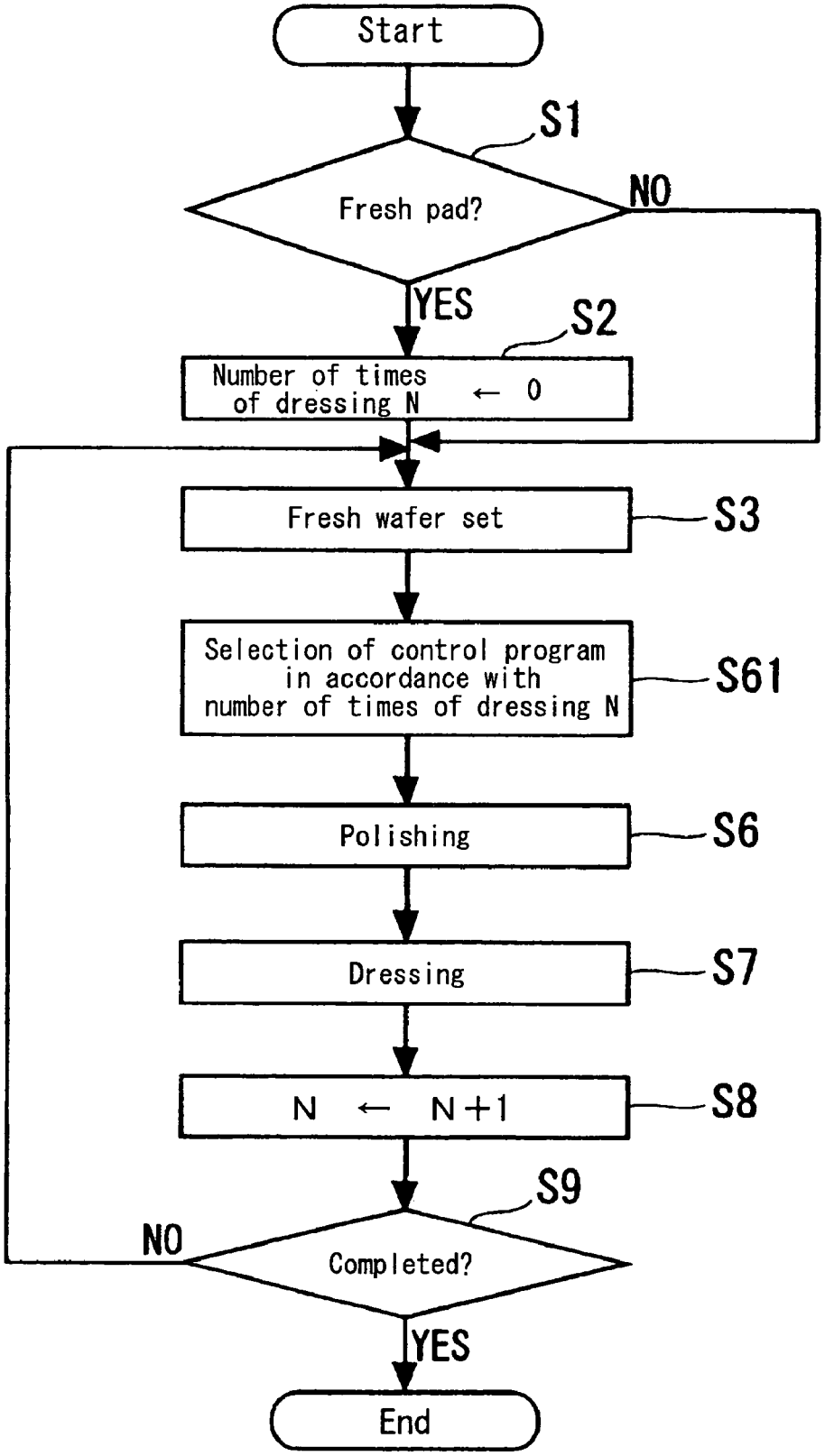
FIG. 9 is a flow chart which shows one example of the operation of the polishing apparatus.

FIG. 9 is a flow chart which shows one example of the operation of the polishing apparatus 1 in this case. In FIG. 9, steps that are the same as steps in FIG. 4, or that correspond to steps in FIG. 4, are labeled with the same symbols, and a redundant description is omitted. In the operation shown in FIG. 9, step S61 is performed instead of steps S4 and S5 in FIG. 4. In step S61, the control part 15 selects control parameters or a control program associated with the most recent number of times of dressing N stored in the internal memory of the control part 15 (step S61). Then, in step S6, the control part 15 causes a polishing operation to be performed in accordance with the control parameters or control program selected in step S61.

In the present working configuration, the same advantages as those of the above-mentioned first working configuration are obtained; furthermore, as is shown in FIG. 9, since no prediction processing or measurement processing is performed in association with the polishing process, the efficiency is improved.

[Fifth Working Configuration]

Figure 10:
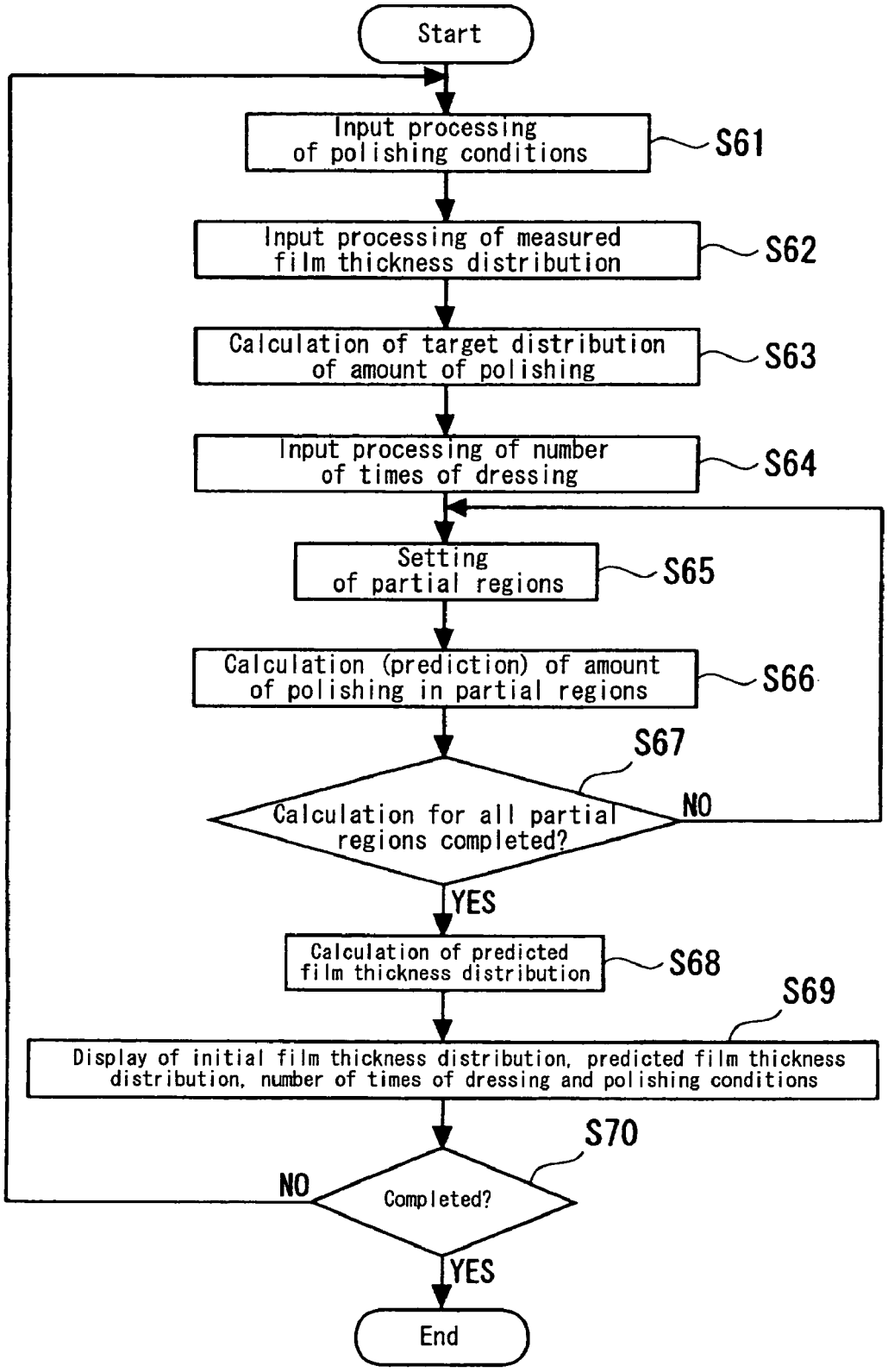
FIG. 10 is a schematic flow chart which shows the operation of a simulation apparatus constituting a fifth working configuration of the present invention.

FIG. 10 is a schematic flow chart which shows the operation of a simulation apparatus constituting a fifth working configuration of the present invention.

The present working configuration is a working configuration which is modified so that the preparation apparatus 4 of the polishing system of the above-mentioned first working configuration shown in FIG. 1 is separated from the measuring apparatus 3, polishing apparatus 1 and displacement meter 31, and is thus made independent, and the operation of the calculation processing part 20 is altered so that this operation has only a simulation function. The block diagram which shows the schematic construction of the preparation apparatus constituting the present working configuration in model form is the same as that of the preparation apparatus 4 shown in FIG. 1. Accordingly, reference will also be made to FIG. 1 in the description of the present working configuration.

In the present working configuration, as in the above-mentioned first working configuration, the relationship between the number of times that dressing is performed on the polishing pad 14 and the height distribution of the polishing pad 14 is stored beforehand in the internal memory of the calculation processing part 20 in the form of a look-up table or the form of an equation in accordance with the material and structure (groove structure), etc., of the polishing pad 14.

When the operation of the preparation apparatus of the present working configuration is initiated, as is shown in FIG. 10, the calculation processing part 20 controls the display part 22 so that this display part 22 is caused to display an input guide display which prompts the operator to input all of the polishing conditions (fixed parameters and adjusted parameters) (step S61). When these polishing conditions are input via the input part 21, the calculation processing part 20 controls the display part 22 so that this display part 22 is caused to display an input guide display which prompts the operator to input the film thickness distribution of the wafer 2 measured by the measuring apparatus 3 (step S62). When this film thickness distribution is input via the input part 21, the calculation processing part 20 calculates the target distribution of the amount of polishing on the basis of the measurement results for the film thickness distribution input in step S62 (step S63).

Next, the calculation processing part 20 controls the display part 22 so that this display part 22 is caused to display an input guide display which prompts the operator to input the number of times of dressing (step S64). When the maximum value of this number of times of dressing is input via the input part 21, the calculation processing part 20 performs steps S65 through S67, which respectively correspond to steps S14 through S16 in FIG. 5. However, in step S66, the calculation processing part 20 obtains the height distribution of the polishing pad 14 corresponding to the number of times of dressing N input in step S64 in accordance with the above-mentioned equation or the above-mentioned look-up table stored beforehand in the internal memory of the calculation processing part 20, and calculates the amount of polishing using this height distribution.

In cases where the result is YES in step S67, the calculation processing part 20 calculates the predicted film thickness distribution of the polished surface of the wafer 2 on the basis of the predicted distribution of the amount of polishing of the polished surface of the wafer 2 obtained up to this point in time and the initial film thickness distribution input in step S62 (step S68). Then, the calculation processing part 20 causes the display part 22 to display the predicted distribution of the amount of polishing, the initial film thickness distribution, the predicted film thickness distribution, the number of times of dressing input in step S64 and the polishing conditions (step S69).

Next, the calculation processing part 20 makes a judgement as to whether there has been a command to continue the simulation or a command to end the simulation from the operator via the input part 22 (step S70). If there has been a command to continue the simulation, the processing returns to step S61. On the other hand, if there has been a command to end the simulation, the operation is ended.

In the present working configuration, as a result of the input of appropriate polishing conditions by the operator, simulation results for the film thickness distribution of the polished surface of the wafer 2, etc., corresponding to these polishing conditions can be obtained. Accordingly, the operator can also use this simulation apparatus to prepare control parameters or a control program for the purpose of controlling the polishing apparatus 1.

[Sixth Working Configuration]

Figure 11:
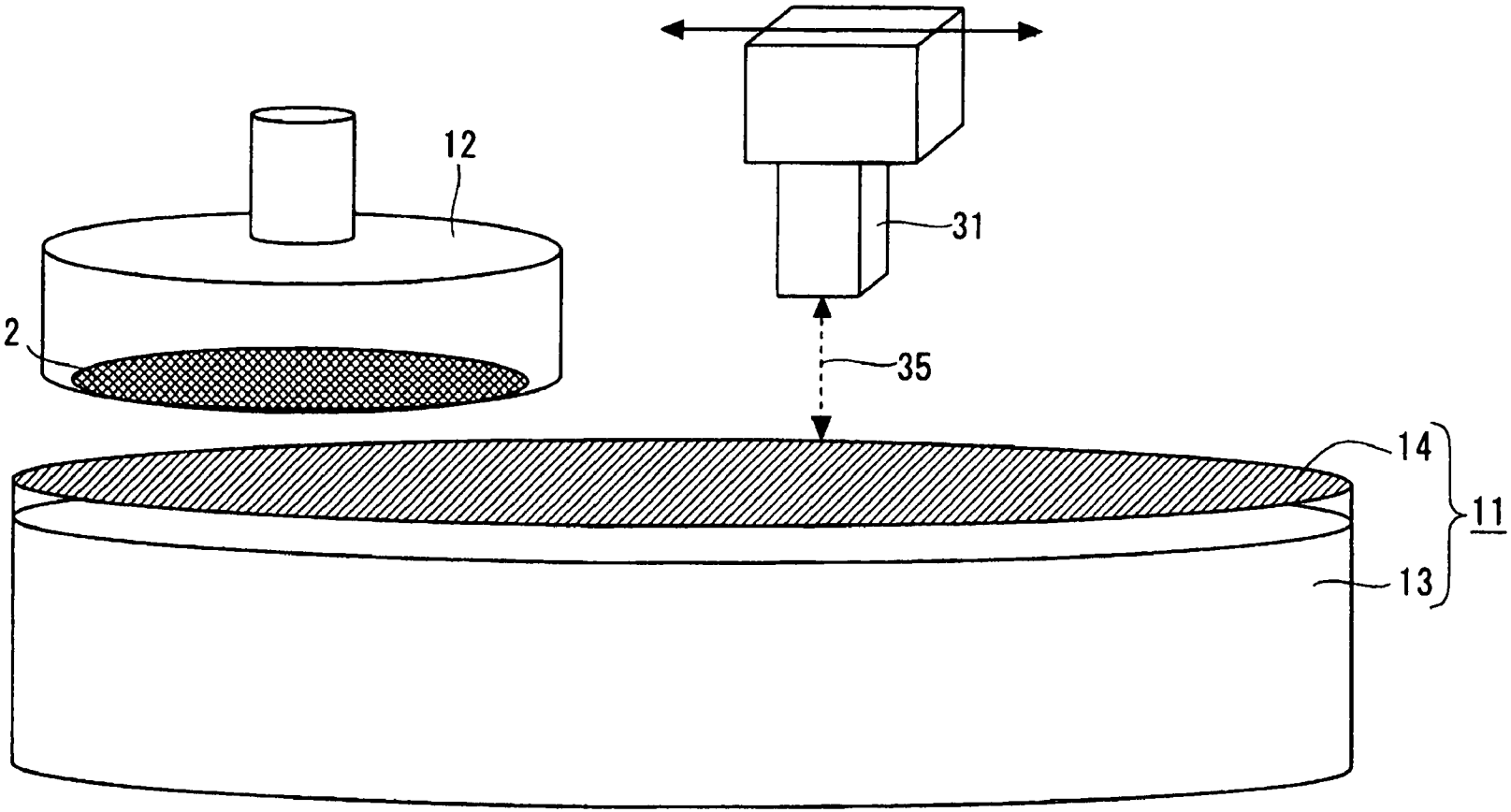
FIG. 11 is a schematic perspective view which shows in model form a portion of a polishing system constituting a sixth working configuration of the present invention.

FIG. 11 is a schematic perspective view which shows a portion of a polishing system constituting a sixth working configuration of the present invention in model form. In FIG. 11, elements that are the same as elements in FIG. 1, or that correspond to elements in FIG. 1, are labeled with the same symbols, and a redundant description is omitted.

The present working configuration differs from the above-mentioned third working configuration only in the following respects. Specifically, in the present working configuration, the diameter of the polishing tool 11 is set at a diameter that is larger than the diameter of the wafer 2, so that a so-called large-diameter pad system is used. Furthermore, an optical-type displacement meter is used as the displacement meter 31, and this displacement meter 31 is disposed in the polishing station so that the height distribution of the polishing pad 14 can also be measured during the polishing of the wafer 2. In FIG. 11, 35 indicates probe light from the displacement meter 31. This displacement meter 31 is devised so that the height distribution of the polishing pad 14 can be measured by moving the displacement meter 31 in radial direction of the polishing pad 14 by means of a moving mechanism not shown in the figures.

In the present working configuration, the height distribution of the polishing pad 14 can thus be measured during the polishing of the wafer 2 as well; accordingly, in the flow chart shown in FIG. 7, the height distribution is simultaneously measured in step S6, and in cases where the result is NO in step S9, the processing may return to step S3.

Advantages similar to those obtained in the above-mentioned third working configuration can also be obtained in the present working configuration. Furthermore, in the present working configuration, since the height distribution of the polishing pad 14 can also be measured during the polishing of the wafer 2, the efficiency can be increased.

[Seventh Working Configuration]

Figure 12:
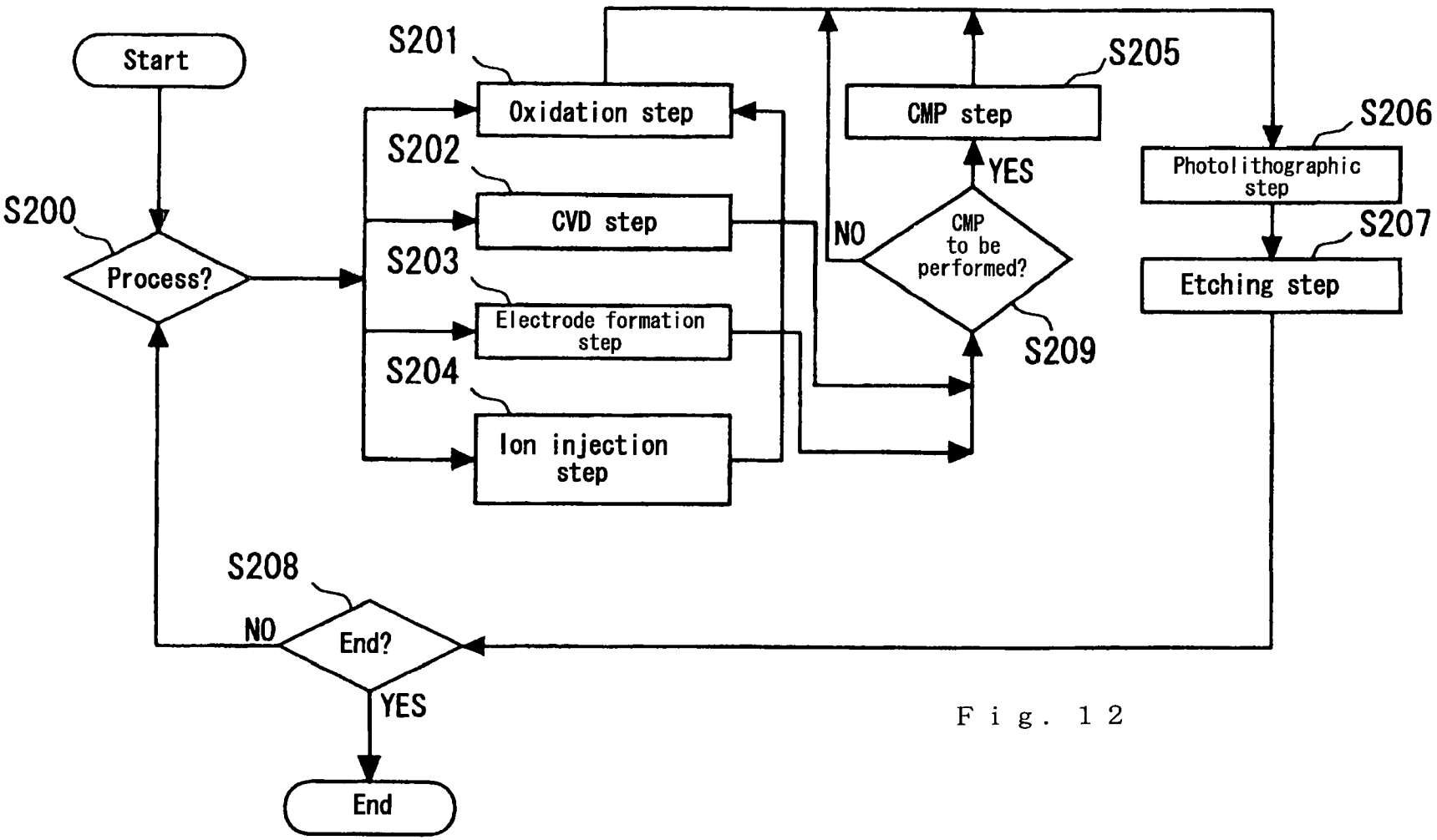
FIG. 12 is a flow chart which shows the semiconductor device manufacturing process.

FIG. 12 is a flow chart which shows a semiconductor device manufacturing process. When the semiconductor device manufacturing process is started, the appropriate treatment process is first selected from the following steps S201 through S204 in step S200. Then, the processing proceeds to one of the steps S201 through S204 in accordance with this selection.

Step S201 is an oxidation process which oxidizes the surface of the silicon wafer. Step S202 is a CVD process in which an insulating film is formed on the surface of the silicon wafer by CVD, etc. Step S203 is an electrode formation process in which electrode films are formed on the silicon wafer by a process such as vacuum evaporation. Step S204 is an ion injection process in which ions are injected into the silicon wafer.

Following the CVD process or electrode formation process, the processing proceeds to step S209, and a judgement is made as to whether or not a CMP process is to be performed. In cases where such a process is not to be performed, the processing proceeds to step S206; on the other hand, in cases where such a process is to be performed, the processing proceeds to step S205. Step S205 is a CMP process; in this process, the flattening of inter-layer insulating films, or the formation of a damascene by the polishing of a metal film on the surface of the semiconductor device, etc., is performed using the polishing apparatus of the present invention.

Following the CMP process or oxidation process, the processing proceeds to step S206. Step S206 is a photolithographic process. In this photolithographic process, the coating of the silicon wafer with a resist, the burning of a circuit pattern onto the silicon wafer by exposure using an exposure apparatus, and the development of the exposed silicon wafer, are performed. Furthermore, the subsequent step S207 is an etching process in which the portions other than the developed resist image are removed by etching, the resist is then stripped away, and etching is completed, so that the unnecessary resist is removed.

Next, in step S208, a judgement is made as to whether or not all of the required processes have been completed. If the processes have not been completed, the processing returns to step S200, and the steps described above are repeated so that a circuit pattern is formed on the silicon wafer. If it is judged in step S208 that all of the processes have been completed, the processing is ended.

In the semiconductor device manufacturing method of the present invention, since the polishing apparatus of the present invention is used in the CMP process, the desired shape of the polished surface of the wafer, or the desired film thickness distribution on the side of the polished surface, can be obtained with good precision in the CMP process. Accordingly, the yield of the CMP process can be improved, and the process efficiency of the CMP process can be increased. As a result, the following merit is obtained: namely, semiconductor devices can be manufactured at a lower cost than in conventional semiconductor device manufacturing methods.

Furthermore, the polishing apparatus of the present invention may also be used in the CMP process of semiconductor device manufacturing processes other than the above-mentioned semiconductor device manufacturing process.

The semiconductor device of the present invention is manufactured by the semiconductor device manufacturing method of the present invention. As a result, the semiconductor device can be manufactured at a lower cost than in a conventional semiconductor device manufacturing method, so that the following merit is obtained: namely, the base cost of manufacture of the semiconductor device drops.

Various working configurations of the present invention were described above, but the present invention is not limited to these working configurations.

For instance, the respective working configurations described above were examples involving application to CMP; however, the present invention can also be applied to the polishing of optical members, etc., made of glass, etc.

[Experimental Example]

The present inventor conducted the following experiment using a polishing system similar to the polishing system shown in FIGS. 1 through 3 (here, the preparation apparatus 4 was omitted).

The polishing pad used (corresponding to the polishing pad 14) was a ring-form pad with an external diameter of 150 mm and an internal diameter of 50 mm. The dresser used (corresponding to the dresser 32) was a ring-form dresser with an external diameter of 100 mm and an internal diameter of 80 mm. In regard to the dressing conditions of the polishing pad, the rpm of the polishing pad was set at 200 rpm, the rpm (forward rotation) of the dresser was set at 90 rpm, the dressing position was set at 55 mm in terms of the center distance (distance between the center of the dresser and the center of the polishing pad), and the dressing load was set at 150 g/cm$^2$. The object of polishing was a wafer with a diameter of 200 mm which had a dielectric film formed on the surface. In regard to the polishing conditions, the rpm of the wafer was set at 200 rpm, the rpm (reverse rotation) of the polishing pad was set at 400 rpm, the starting position of the swinging motion was set at 25 mm in terms of the center distance (distance between the center of the wafer and the center of the polishing pad), the swinging width was set at 40 mm, and the load was set at 200 g/cm$^2$.

Figure 14:
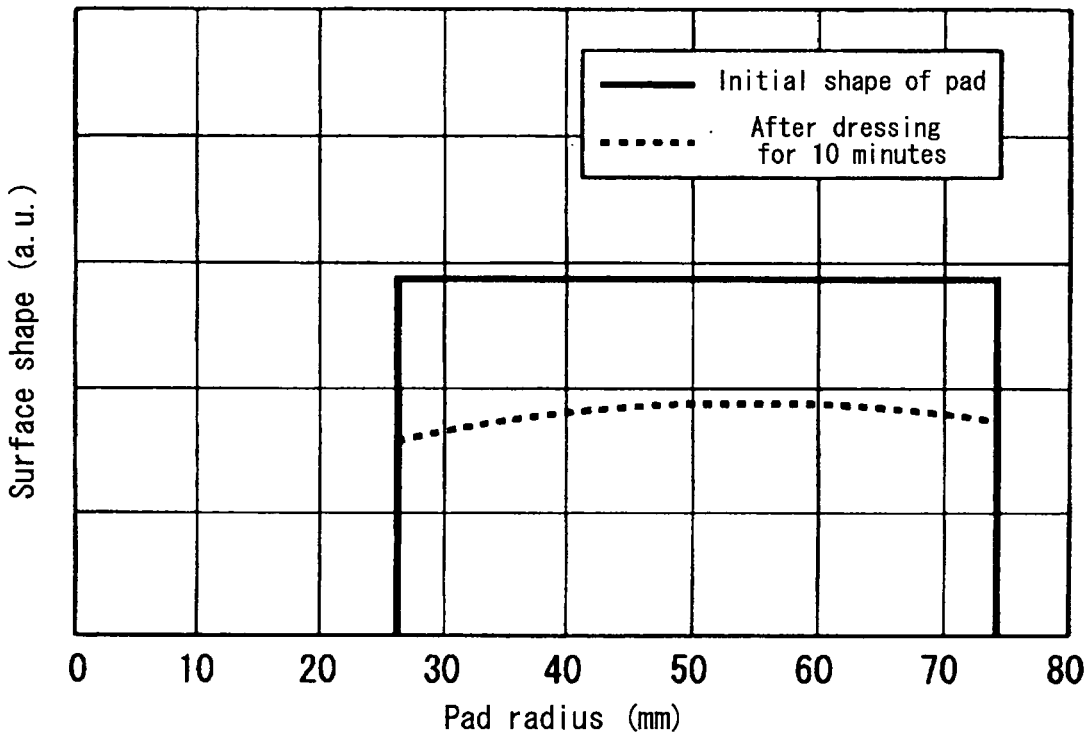
FIG. 14 is a graph which shows experimental data indicating the variation in the surface shape that accompanies the progress of the dressing of the polishing pad.
Figure 15:
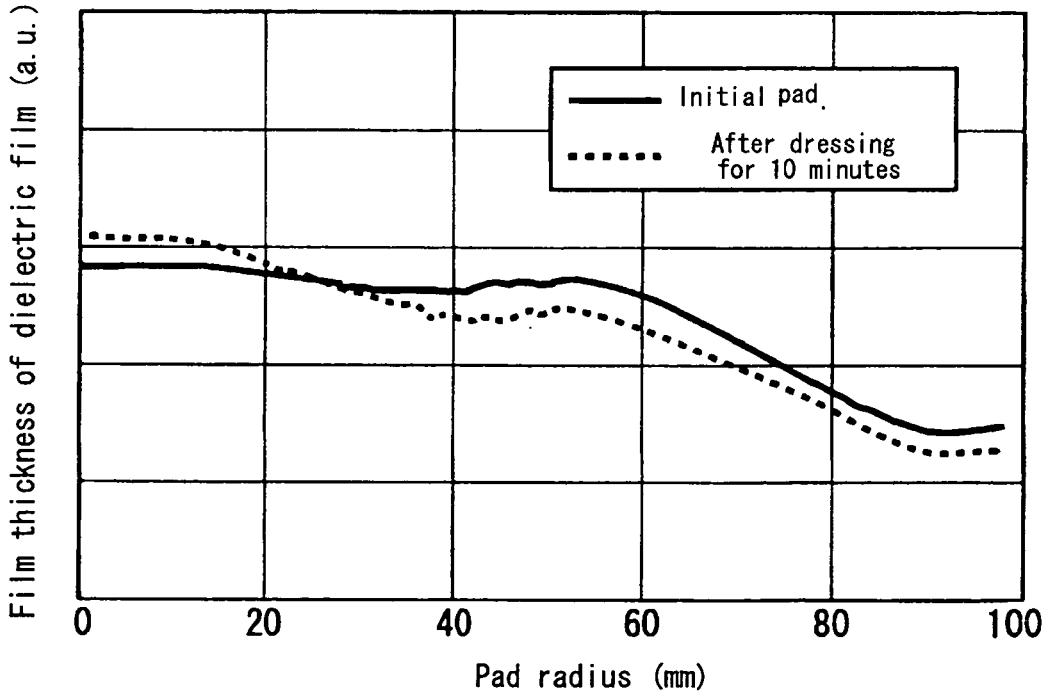
FIG. 15 is a graph which shows differences in the distribution of the amount of polishing of polishing pads with different surface shapes in terms of experimental data.

Each time that one wafer was polished under the above-mentioned polishing conditions (i.e., with each single polishing process), a dressing process was performed under the above-mentioned dressing conditions. The surface shape (height distribution) of the polishing pad was measured using a contact needle-type displacement meter in accordance with the cumulative dressing time. As a result, the flatness of the surface of the polishing pad dropped with each number of times of dressing, and a difference such as that shown in FIG. 14 was seen between the initial surface shape and the surface shape following a cumulative dressing time of 10 minutes. Here, the amount of polishing of the dielectric film on the surface of the above-mentioned wafer following respective polishing processes of the above-mentioned wafer under the same polishing conditions described above showed a deviation as indicated in FIG. 15 between a case in which the initial polishing pad was used and a case in which the polishing pad following a cumulative dressing time of 10 minutes was used. In other words, it was ascertained that the amount of polishing deviates from the specified amount of polishing under the initially set polishing conditions.

Accordingly, prediction calculations were performed in which the surface state of the pad was varied according to the cumulative dressing time, and the polishing conditions were appropriately altered in order to correct the distribution (profile) of the amount of polishing obtained. Then, the pad shape at respective cumulative times was measured with the contact-type displacement meter, these measurements were formed into a data base, and the alterations in the polishing conditions were also input beforehand in accordance with these measurements. As a result, it was possible to construct a system which allowed stable polishing that also incorporated the variation in the shape of the pad caused by dressing. This experimental example resembles the above-mentioned fourth working configuration and the polishing apparatus performing the operation shown in FIG. 9.

It was possible to predict the variation in the surface shape of the pad in the above-mentioned experimental results in accordance with the equation of Preston and a slight correction. Furthermore, the results of wafer polishing in the predicted pad surface state also agreed with the calculations. Accordingly, it was found that the measurement data for the pad surface state in the above-mentioned experimental results and the polishing conditions in certain pad surface states induced by actually polishing the wafer could all be replaced by data obtained by calculation; thus, the effectiveness of a system using calculated data was indicated.

INDUSTRIAL APPLICABILITY

The present invention can be used to achieve accurate polishing in polishing processes, and to manufacture semiconductors with a good yield in semiconductor device manufacturing processes.

The invention claimed is:

1. A method of controlling an apparatus that polishes a surface by causing relative motion between the surface and a face of a polishing body supported by a substrate while applying a load between the surface and the face of the polishing body, the polishing body having an elastic constant, the method comprising:

a simulation stage in which a distribution of an amount of polishing of the surface is predicted according to set control parameters or a set control program using a simulation method; and a judgment stage in which the acceptability of the set control parameters or control program is judged by comparing the distribution of the amount of polishing predicted in the simulation stage to a desired distribution of an amount of polishing of the surface;

wherein the simulation method is characterized by a step which predicts the amount of polishing of discrete portions of the surface using an indicator which determines a height distribution of the face of the polishing body with reference to the substrate when no pressure is applied to the polishing body, and uses the height distribution and the elastic constant in calculations performed in the simulation stage; and the indicator comprises at least one indicator method selected from a set consisting of a number of times that a dressing process is performed on the polishing body, the cumulative time of the dressing processes performed on the surface by the polishing body, and the cumulative time of polishing performed on the surface by the polishing body.

2. The method according to claim 1, wherein if the judgment in the judgment stage is unacceptable, the set control parameters or control program are changed with respect to the control parameters or control program already judged unacceptable in the judgment stage, and the simulation stage and judgment stage are repeated in that order until the control parameters or control program obtained is judged to be acceptable.

3. The method according to claim 1, wherein the height distribution of the polishing body is successively predicted on the basis of the indicator, and the amount of polishing in the partial regions predicted on the basis of the most recently predicted height distribution.

4. The method according to claim 2, wherein the prediction of the height distribution is performed following a dressing of the polishing body.

5. The method according to claim 2, wherein the prediction of the height distribution is accomplished by referring to a look-up table or equation which provides a relationship between the height distribution and at least one parameter selected from a set comprising the number of times that a dressing process is performed on the polishing body, the cumulative time of the dressing processes performed on the surface by the polishing body, and the cumulative time of polishing performed on the surface by the polishing body.

6. The method according to claim 2, wherein the prediction of the height distribution is performed in accordance with Preston's equation.

7. The method according to claim 1, wherein the polishing is chemical mechanical polishing performed with a polishing agent interposed between the polishing body and the surface.

* * * * *